US012529201B2

(12) United States Patent
Toyoda et al.

(10) Patent No.: US 12,529,201 B2
(45) Date of Patent: Jan. 20, 2026

(54) WORK MACHINE CONTROL METHOD, WORK MACHINE CONTROL PROGRAM, WORK MACHINE CONTROL SYSTEM, AND WORK MACHINE

(71) Applicant: Yanmar Holdings Co., Ltd., Osaka (JP)

(72) Inventors: Masashi Toyoda, Fukuoka (JP); Junya Sakata, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 160 days.

(21) Appl. No.: 18/387,027

(22) Filed: Nov. 4, 2023

(65) Prior Publication Data

US 2024/0175235 A1 May 30, 2024

(30) Foreign Application Priority Data

Nov. 24, 2022 (JP) ..... 2022-187222

(51) Int. Cl.
*E02F 3/43* (2006.01)
*E02F 3/32* (2006.01)

(52) U.S. Cl.
CPC ..... *E02F 3/431* (2013.01); *E02F 3/32* (2013.01)

(58) Field of Classification Search
CPC ..... E02F 3/32; E02F 3/431; E02F 3/435
See application file for complete search history.

(56) References Cited

U.S. PATENT DOCUMENTS

| | | | | |
|---|---|---|---|---|
| 6,293,033 | B1 * | 9/2001 | Moriya | E02F 9/2012 701/50 |
| 9,771,705 | B2 * | 9/2017 | Horstman | E02F 9/2203 |
| 9,777,460 | B2 * | 10/2017 | Wuisan | E02F 3/764 |
| 9,777,461 | B2 * | 10/2017 | Wuisan | E02F 3/765 |
| 9,797,114 | B2 * | 10/2017 | Maifield | E02F 9/2012 |
| 10,066,367 | B1 * | 9/2018 | Wang | E02F 9/262 |
| 10,145,084 | B2 * | 12/2018 | Fredrickson | E02F 9/2012 |
| 10,711,436 | B2 * | 7/2020 | Tomita | F15B 21/02 |
| 11,512,446 | B2 * | 11/2022 | Breutzman | E02F 9/265 |
| 2014/0271078 | A1 * | 9/2014 | Koch | E02F 9/265 414/815 |
| 2016/0179128 | A1 * | 6/2016 | Guglielmo | G06F 3/016 182/19 |
| 2018/0058039 | A1 * | 3/2018 | Fredrickson | G05G 5/05 |
| 2019/0071119 | A1 * | 3/2019 | Takenaka | E02F 9/08 |
| 2020/0123738 | A1 * | 4/2020 | Espinosa | E02F 9/221 |
| 2020/0125132 | A1 * | 4/2020 | Wakuda | G06F 3/0338 |
| 2021/0341033 | A1 * | 11/2021 | Breutzman | G05G 5/02 |
| 2021/0341960 | A1 * | 11/2021 | Kenkel | B62D 1/12 |
| 2022/0275602 | A1 * | 9/2022 | Okada | E02F 3/965 |

* cited by examiner

*Primary Examiner* — Tyler J Lee
(74) *Attorney, Agent, or Firm* — Chris Mizumoto

(57) ABSTRACT

A control method for a work machine is a control method for the work machine including a machine body that makes a motion according to an operation of an operation device. This control method has: changing a first operation pattern as a corresponding relationship between an operation of a first operation element in an operation device and the motion of the machine body; and setting a second operation pattern in association with the first operation pattern, the second operation pattern being a corresponding relationship between an operation of a second operation element in the operation device, which is performed in association with the operation of the first operation element, and the motion of the machine body.

9 Claims, 10 Drawing Sheets

WORK MACHINE CONTROL METHOD, WORK MACHINE CONTROL PROGRAM, WORK MACHINE CONTROL SYSTEM, AND WORK MACHINE

CROSS-REFERENCE

This application claims foreign priority of JP2022-187222 filed Nov. 24, 2022, the disclosures of which are hereby incorporated by reference in their entirety.

TECHNICAL FIELD

The present invention relates to a work machine control method, a work machine control program, and a work machine control system that are used for a work machine, and to a work machine including a machine body that makes a motion according to an operation of an operation device.

BACKGROUND ART

As the related art, a shovel as a work machine (an excavator) has been known. The shovel includes: a lower travel body; an upper turning body that is turnably mounted on the lower travel body via a turning mechanism; and an arm, a boom, and a bucket that are attached to the upper turning body (for example, see Patent Document 1). In the related art, the arm is attached to a tip of the boom, and the bucket as an end attachment is attached to a tip of the arm.

The work machine according to the related art enables autonomous running of an actuator such that teeth of the bucket move along a target route based on a target working surface, and a slope formed by slope finishing work, a flat surface formed by leveling work, or the like is set as the target working surface. That is, this work machine has a function to assist an operator with a manual operation of the work machine by autonomous running of the actuator. More specifically, a left operation lever for operating the arm is provided with a switch. When the operator manually operates the left operation lever while pressing this switch to perform an arm closing operation, at least one of the boom and the bucket makes a motion autonomously such that the target route and positions of the teeth of the bucket match each other. In this way, simply by operating the left operation lever in an arm closing direction, for example, the operator can close the arm while making the teeth of the bucket match the target route (the target working surface).

PRIOR ART DOCUMENT

Patent Document

Patent Document 1: Japanese Unexamined Patent Application Publication No. 2021-25258

SUMMARY OF INVENTION

Technical Problem

An operation pattern, as a corresponding relationship between the operation of the operation lever and a motion of the work machine, is fixed for the work machine according to the related art. However, it may be desired that the operation pattern is changeable according to familiarity, preference, or the like by the operator. In such a case, for example, it is assumed that the arm closing operation is assigned not to the left operation lever but to a right operation lever. Then, when the operator moves the bucket along the target route, the operator has to operate the right operation lever to perform the arm closing operation while pressing the switch on the left operation lever. Thus, the operator has to press the switch on the left operation lever while operating the right operation lever, which is a complicated operation. For this reason, the operator has to be careful not to make an operation error that the unintentional operation of the left operation lever causes the motion of the boom or the like.

An object of the present invention is to provide a work machine control method, a work machine control program, a work machine control system, and a work machine easily reducing an operation burden on an operator.

Solution to Problem

A work machine control method according to one aspect of the present invention is a control method for a work machine including a machine body that makes a motion according to an operation of an operation device, and has: changing a first operation pattern as a corresponding relationship between an operation of a first operation element in the operation device and the motion of the machine body; and setting a second operation pattern in association with the first operation pattern, the second operation pattern being a corresponding relationship between an operation of a second operation element in the operation device, which is performed in association with the operation of the first operation element, and the motion of the machine body.

A work machine control program according to one aspect of the present invention is a program for causing one or more processors to execute the work machine control method.

A work machine control system according to one aspect of the present invention is used for a work machine including a machine body that makes a motion according to an operation of an operation device. The work machine control system includes a change processing unit and a setting processing unit. The change processing unit changes a first operation pattern that is a corresponding relationship between an operation of a first operation element in the operation device and the motion of the machine body. The setting processing unit sets a second operation pattern in association with the first operation pattern, the second operation pattern being a corresponding relationship between an operation of a second operation element in the operation device, which is performed in association with the operation of the first operation element, and the motion of the machine body.

A work machine according to one aspect of the present invention includes the work machine control system and the machine body.

Advantageous Effects of Invention

The present invention can provide the work machine control method, the work machine control program, the work machine control system, and the work machine easily reducing an operation burden on an operator.

DESCRIPTION OF EMBODIMENTS

A description will hereinafter be made on embodiment of the present invention with reference to the accompanying drawings. Each of the following embodiments is merely one example that embodies the present invention and thus is not intended to limit the technical scope of the present invention.

First Embodiment

[1] Overall Configuration

Figure 1:
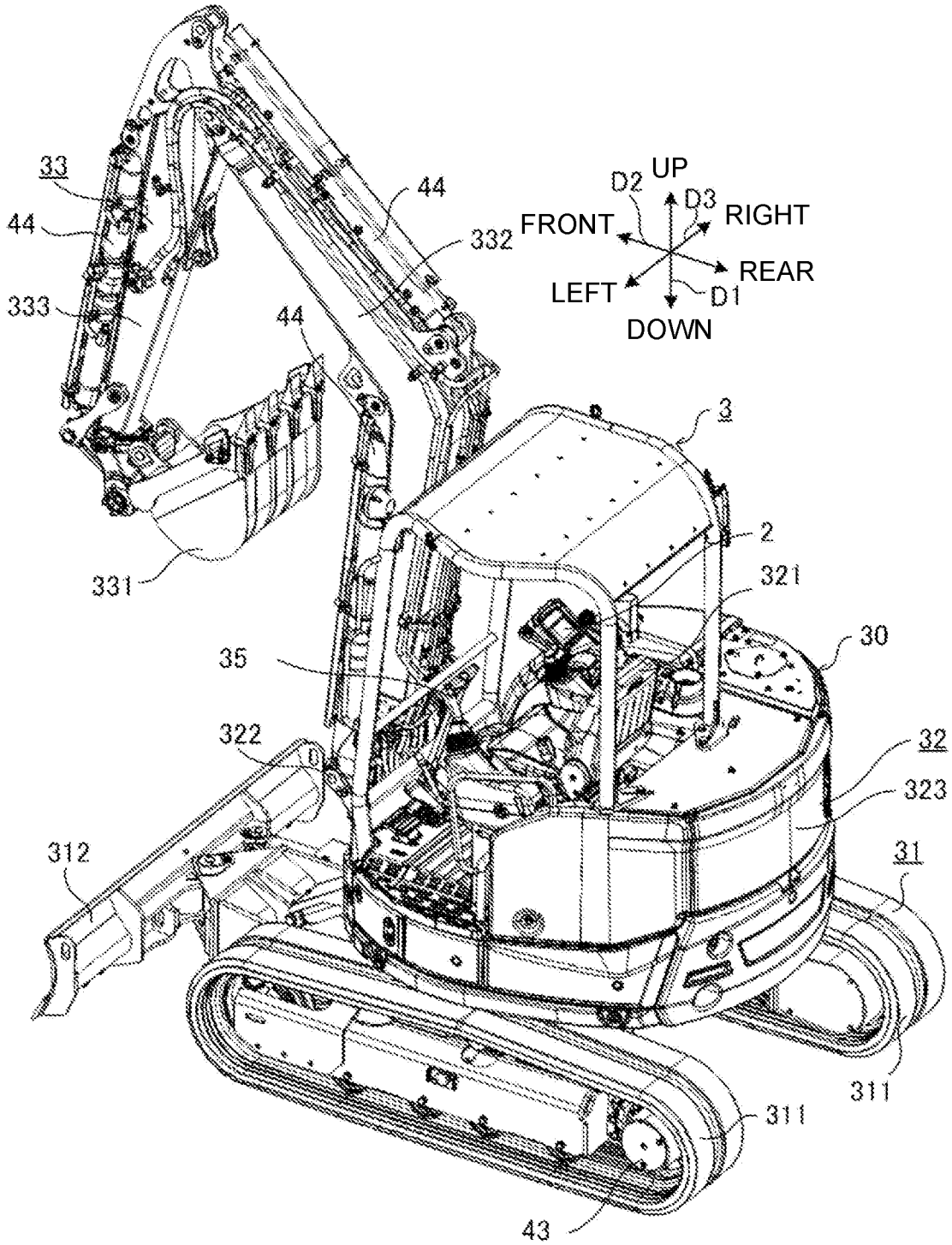
FIG. 1 is a schematic perspective view illustrating an overall configuration of a work machine according to a first embodiment.
Figure 2:
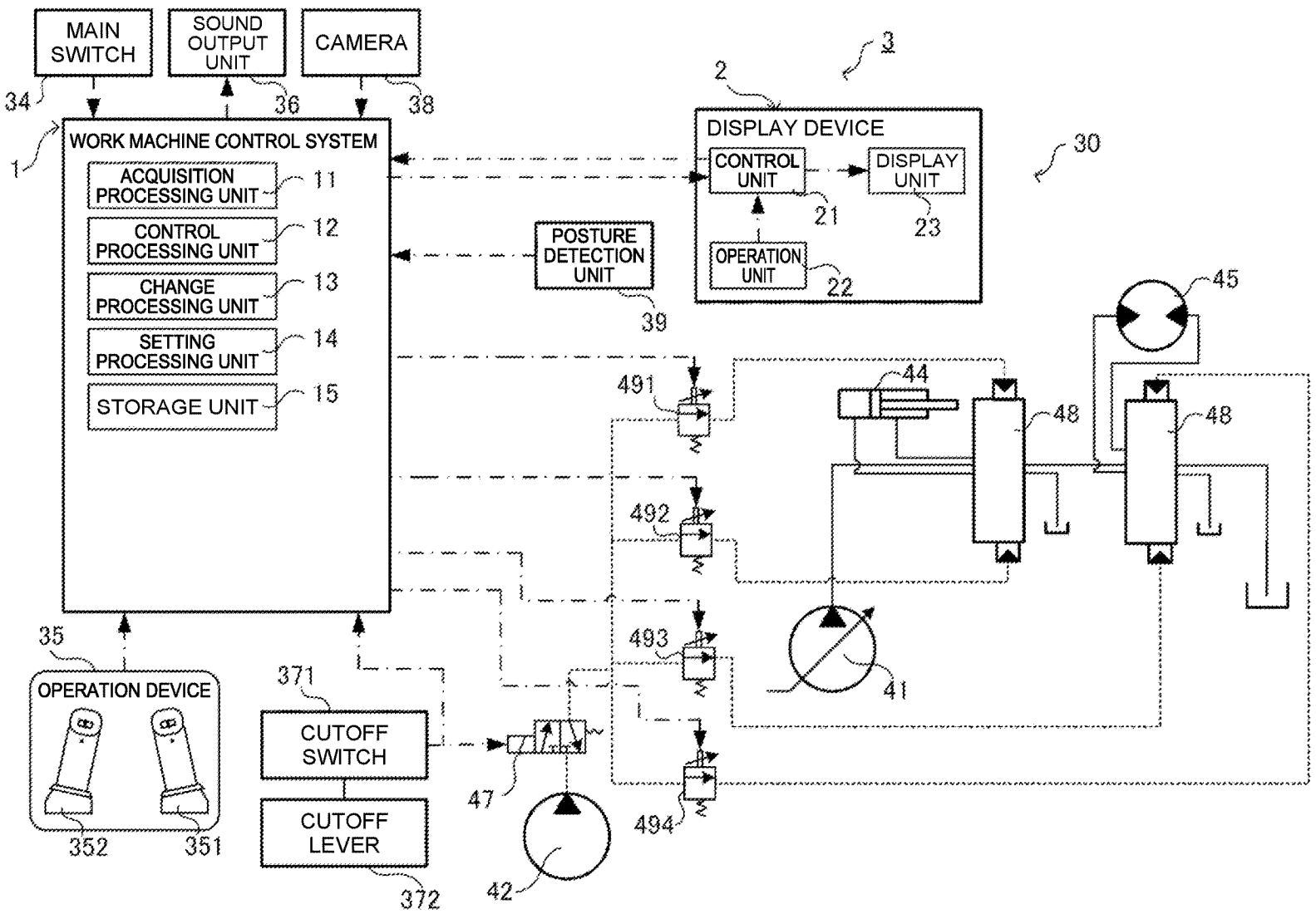
FIG. 2 is a schematic block diagram of the work machine according to the first embodiment.

As illustrated in FIG. 1, a work machine 3 according to the present embodiment includes, in a machine body 30, a travel unit 31, a turning unit 32, and a work unit 33. As illustrated in FIG. 2, the work machine 3 further includes a work machine control system 1 (hereinafter also simply referred to as a "control system 1"). In addition to the above, as illustrated in FIG. 1 and FIG. 2, the machine body 30 includes a display device 2, a main switch 34, an operation device 35, a sound output unit 36, a camera 38, a posture detection unit 39, a cutoff switch 371, a cutoff lever 372, and the like.

The "work machine" described in the present disclosure means a machine for any of various types of work, and examples thereof are work vehicles such as backhoes (including a hydraulic shovel and a mini shovel), a wheel loader, and a carrier. The work machine 3 includes the work unit 33 configured to be able to perform one or more types of work. The work machine 3 is not limited to the "vehicle" and may be a work vessel, a flying work body such as a drone or a multi-copter, or the like, for example. Furthermore, the work machine 3 is not limited to a construction machine (construction equipment) and may be an agricultural machine (agricultural equipment) such as a rice transplanter, a tractor, or a combine harvester, for example. In the present embodiment, unless otherwise specified, a description will be made on, as an example, a case where the work machine 3 is a riding-type backhoe and can perform excavation work, land leveling work, trenching work, loading work, or the like as the work. In detail, it is assumed that the work machine 3 according to the present embodiment is of an "ultra-small turning type" in which the turning unit 32 including the work unit 33 can make a full turn within 120% of an overall width of the travel unit 31 (an overall width of a right and left pair of crawlers 311) or of a "rear ultra-small turning type" in which a rear end turning radius ratio is within 120%.

In the present embodiment, a vertical direction in a usable state of the work machine 3 will be defined as an up-down direction D1 for convenience of description. Furthermore, in a non-turning state of the turning unit 32, a front-rear direction D2 and a right-left direction D3 will be defined with directions seen from a user (an operator) who gets in (a driving unit 321 of) the work machine 3 being a reference. In other words, each of the directions used in the present embodiment is a direction that is defined with the machine body 30 of the work machine 3 being the reference. A movement direction of the machine body 30 during forward travel of the work machine 3 will be defined as "front", and a movement direction of the machine body 30 during reverse travel of the work machine 3 will be defined as "rear". Similarly, a direction in which a front end portion of the machine body 30 moves during a right turn of the work machine 3 will be defined as "right", and a direction in which the front end portion of the machine body 30 moves during a left turn of the work machine 3 will be defined as "left". Here, these directions are not intended to limit a use direction (a direction in use) of the work machine 3.

The work machine 3 includes an engine as a power source. In the present embodiment, as an example, the engine is a diesel engine. The engine is driven by fuel (herein, diesel fuel) that is supplied from a fuel tank. In the work machine 3, the machine body 30 is driven, for example, when the engine drives a hydraulic pump 41 (see FIG. 2), and hydraulic oil is supplied from the hydraulic pump 41 to hydraulic actuators (including a hydraulic motor 43, a hydraulic cylinder 44, and the like) in parts of the machine body 30. Such a work machine 3 is controlled, for example, when the user (the operator) who gets in the driving unit 321 of the machine body 30 operates operation levers 351, 352 (see FIG. 2) of the operation device 35, or the like.

In the present embodiment, it is assumed that the work machine 3 is the riding-type backhoe as described above. Thus, the work unit 33 is driven according to the operation by the user (the operator) who gets in the driving unit 321, and performs the work such as the excavation work. The driving unit 321, which the user gets in, is provided to the turning unit 32.

Here, the display device 2 and the operation device 35 are mounted to the driving unit 321 of the machine body 30. The user can operate the operation device 35 while looking at various types of information on the work machine 3 that are displayed on the display device 2. As an example, information on an actuation state of the work machine 3, such as a coolant temperature and a hydraulic oil temperature, is displayed on a display screen of the display device 2. Accordingly, the user can check, on the display device 2, the information on the actuation state of the work machine 3 that is required for an operation of the operation device 35.

The travel unit 31 has a travel function and is configured to be able to travel (also turn) on the ground. The travel unit 31 has the right and left pair of crawlers 311 and a blade 312, for example. The travel unit 31 further includes the travel-directed hydraulic motor 43 (hydraulic actuator) and the like for driving the crawlers 311.

The turning unit 32 is located above the travel unit 31 and is configured to be turnable about a rotation axis along the vertical direction with respect to the travel unit 31. The turning unit 32 has a hydraulic motor 45 (see FIG. 2) as a turning hydraulic actuator, and the like. In addition to the driving unit 321, the engine, the hydraulic pump 41, and the like are mounted to the turning unit 32. Furthermore, a boom bracket 322, to which the work unit 33 is attached, is provided to a front end portion of the turning unit 32.

The work unit 33 is configured to be able to perform one or more types of the work. The work unit 33 is supported by the boom bracket 322 of the turning unit 32 and performs the work. The work unit 33 has a bucket 331. The bucket 331 is a type of an attachment (a work tool) that is attached to the machine body 30 of the work machine 3, and is an appropriate tool that is selected from plural types of the attachments according to a work content. As an example, the bucket 331 is detachably attached to the machine body 30 and is replaced according to the work content. Examples of the (end) attachment for the work machine 3 are, in addition to the bucket 331, various tools such as a breaker 334 (see FIG. 10), an auger, a crusher, a fork, a fork claw, a steel cutter, an asphalt cutter, a mower, a ripper, a mulcher, a tilt rotator, and a tamper.

The work unit 33 further has a boom 332, an arm 333, and the hydraulic actuators (including the hydraulic cylinder 44, a hydraulic motor, and the like), and the like. The bucket 331 is attached to a tip of the arm 333. The bucket 331 is supported by the arm 333 in a manner to be rotatable about a rotation axis along a horizontal direction.

The boom 332 is rotatably supported by the boom bracket 322 of the turning unit 32. More specifically, the boom 332 is supported by the boom bracket 322 in a manner to be rotatable about a rotation axis along the horizontal direction. The boom 332 has a shape that extends upward from a base end portion supported by the boom bracket 322. The arm 333 is coupled to a tip end of the boom 332. The arm 333 is supported by the boom 332 in a manner to be rotatable about a rotation axis along the horizontal direction.

The work unit 33 is powered by the engine as the power source. More specifically, the hydraulic pump 41 is driven by the engine and supplies the hydraulic oil to the hydraulic actuators (the hydraulic cylinder 44 and the like) of the work unit 33. In this way, each of the components (the bucket 331, the boom 332, and the arm 333) of the work unit 33 makes a motion.

In particular, in the present embodiment, the work unit 33 has a multi-joint structure in which the boom 332 and the arm 333 are configured to be separately rotatable. In other words, each of the boom 332 and the arm 333 rotates about the rotation axis along the horizontal direction. In this way, the multi-joint work unit 33, which includes the boom 332 and the arm 333, can make an extending motion and a folding motion as a whole, for example. Furthermore, the bucket 331 as the attachment is supported by the machine body 30 (the turning unit 32) via the boom 332 and the arm 333, and can be opened/closed when the bucket 331 itself rotates with respect to the arm 333.

Similar to the work unit 33, each of the travel unit 31 and the turning unit 32 is powered by the engine as the power source. That is, each of the turning unit 32 and the travel unit 31 makes a motion when the hydraulic oil is supplied from the hydraulic pump 41 to the hydraulic motor 43 of the travel unit 31, the hydraulic motor 45 of the turning unit 32, and the like.

The work machine 3 further includes a drive device (mechanism) such as a power take-off (PTO) for supplying the power to the bucket 331 (the attachment). More specifically, the drive device regulates a magnitude of the power supplied to the bucket 331 by delivering the hydraulic oil from the hydraulic pump 41, which is driven by the engine, to the bucket 331 and regulating a flow rate of the hydraulic oil. Here, the drive device has plural (four as an example in the present embodiment) PTO ports, that is, output ports (hereinafter, a "PTO1", a "PTO2", a "PTO3", and a "PTO4"). The PTO1 to the PTO4 can separately regulate the power, that is, the flow rate of the hydraulic oil.

FIG. 2 schematically illustrates a hydraulic circuit and an electrical circuit (an electrical connection relationship) of the work machine 3 according to the present embodiment. In FIG. 2, a solid line represents a high-pressure oil path (for the hydraulic oil), a dotted line represents a low-pressure oil path (for pilot oil), and a one-dot chain arrow represents an electrical signal path.

As illustrated in FIG. 2, the work machine 3 includes a pilot pump 42, first control valves 491 to 494, a second control valve 47, a direction switching valve (control valve) 48, and the like, in addition to the hydraulic pump 41, the hydraulic cylinder 44, and the hydraulic motor 45. FIG. 2 illustrates the only one hydraulic cylinder 44 for driving the boom 332. However, the same hydraulic circuit is configured for the hydraulic cylinder 44 for driving the arm 333, the bucket 331, or the like. In addition, FIG. 2 only illustrates the hydraulic motor 45 of the turning unit 32. However, the same hydraulic circuit is configured for the hydraulic motor 43 of the travel unit 31.

The hydraulic oil from the hydraulic pump 41, which is driven by the engine, is supplied to the hydraulic motor 43 of the travel unit 31, the hydraulic motor 45 of the turning unit 32, the hydraulic cylinder 44 of the work unit 33, and the like. In this way, the hydraulic actuators such as the hydraulic motors 43, 45 and the hydraulic cylinder 44 are driven.

Each of the hydraulic actuators, such as the hydraulic motors 43, 45 and the hydraulic cylinder 44, includes the pilot-type direction switching valve 48 capable of changing a direction and a flow rate of the hydraulic oil supplied from the hydraulic pump 41. The direction switching valve 48 is driven when the pilot oil serving as an input instruction is supplied from the pilot pump 42.

Here, pilot oil supply paths to the direction switching valves 48 are respectively provided with the first control valves 491 to 494. Each of the first control valves 491 to 494 is an electromagnetic control valve (a solenoid valve) and is inserted between the direction switching valve 48 and the pilot pump 42. Each of the first control valves 491 to 494 is connected to the control system 1 and is run in response to a control signal (a supply current) from the control system 1. More specifically, the control system 1 controls the first control valves 491 to 494 according to the operation of the operation device 35 and instructs, for example, a deployment motion and a reduction motion of the work unit 33. It is assumed herein that each of the first control valves 491 to 494 is an (electromagnetic) proportional control valve. However, each of the first control valves 491 to 494 is not limited thereto and may be, for example, an on-off valve capable of switching between opening and closing of a flow path.

Such direction switching valves and first control valves are provided not only to the hydraulic cylinder 44 for driving the boom 332 and the hydraulic motor 45 of the turning unit 32 but also to the hydraulic circuits of the hydraulic cylinders 44 for driving the arm 333 and the bucket 331 and the hydraulic circuit of the hydraulic motor 43 of the travel unit 31. Thus, each of the travel unit 31, the turning unit 32, and the work unit 33 can make the motion according to the operation of the operation device 35.

Furthermore, the second control valve 47 is provided on an upstream side of the first control valves 491 to 494 in the pilot oil path. The second control valve 47 is an electromagnetic control valve (a solenoid valve), and is inserted between the pilot pump 42 and the plural first control valves 491 to 494. The second control valve 47 is connected to a power supply via the cutoff switch 371 and is run in response to a supply current from the power supply. Here, the second control valve 47 opens the flow path of the pilot oil in an energized state, that is, in a state where the current as a control signal is supplied, and closes the flow path of the pilot oil in a de-energized state, that is, in a state where the current as the control signal is shut off. Accordingly, the hydraulic actuators (the hydraulic cylinder 44 and the like) are no longer driven when the supply current to the second control valve 47 is shut off, and the hydraulic actuators are forcibly stopped regardless of the operation of the operation device 35.

The cutoff switch 371 is linked to the cutoff lever 372. The cutoff lever 372 is arranged in the driving unit 321 of the machine body 30 and accepts an operation input by the user (the operator). In the present embodiment, as an example, the cutoff lever 372 can be operated in the up-down direction D1. When the cutoff lever 372 is located at an "up position" as an upper end position within a movable range, the cutoff switch 371 is "off". When the cutoff lever 372 is located at a "down position" as a lower end position within the movable range, the cutoff switch 371 is "on". The cutoff switch 371 is connected to the control system 1, and on/off of the cutoff switch 371 is monitored by the control system 1.

Thus, when the cutoff lever 372 is located at the "down position", the second control valve 47 is brought into the energized state, and the hydraulic actuators (the hydraulic cylinder 44 and the like) are driven by the operation of the operation device 35. In contrast, when the cutoff lever 372 is located at the "up position", the second control valve 47 is brought into the de-energized state, the hydraulic actuators are forcibly stopped regardless of the operation of the operation device 35. Accordingly, in order to drive the hydraulic actuators (the hydraulic cylinder 44 and the like), the user (operator) needs to operate the cutoff lever 372 to the "down position".

Furthermore, each of the turning unit 32 and the travel unit 31 also makes the motion when the hydraulic oil is supplied from the hydraulic pump 41 to the hydraulic actuators (the hydraulic motors 43, 45 and the like). Accordingly, when the cutoff lever 372 is located at the "up position", neither the turning unit 32 nor the travel unit 31 is driven. That is, when the cutoff lever 372 is located at the "up position", all of the work unit 33, the turning unit 32, and the travel unit 31 are forcibly brought into an undrivable state.

In short, the cutoff switch 371, when being off, is in a "locked state" where the motion of the work machine 3 is limited (including prohibited), and when being on, is in an "unlocked state" where the motion of the work machine 3 is not limited. Then, when the cutoff lever 372 is located at the "up position" and the cutoff switch 371 is in the locked state (off), the motion of the work machine 3 is forcibly limited regardless of the operation of the operation device 35. The cutoff lever 372 is a lever that is operated to lock the motion of the work machine 3 just as described, and is synonymous with a gate lock lever.

The main switch 34 is arranged in the driving unit 321 of the machine body 30 and is operated by the user (the operator) at a start of the work machine 3. While the main switch 34 remains off, the machine body 30 (including the travel unit 31, the turning unit 32, and work unit 33) does not make the motion according to the operation of the operation device 35. Only when the main switch 34 is turned on, the machine body 30 makes the motion according to the operation of the operation device 35. When the main switch 34 is turned on, the energization of the display device 2 and the like is also started. In the present embodiment, as an example, the main switch 34 is linked to a key cylinder, and is turned on when a start operation (ignition on) of the engine is performed by using a key.

The operation device 35 is arranged in the driving unit 321 of the machine body 30 and is a user interface for accepting the operation input by the user (the operator). The operation device 35 is the electric operation device 35 and accepts any of various operations from the user by outputting an electrical signal (an operation signal) corresponding to the user's operation to the control system 1. In the present embodiment, as one example, the operation device 35 includes a pair of the operation levers 351, 352 (see FIG. 3). A detailed description on the operation device 35 will be made in the section "[2] Operation Device".

The sound output unit 36 outputs sound (including voice) to the user (the operator). The sound output unit 36 includes a buzzer, a speaker, or the like and outputs the sound upon reception of the electric signal. The sound output unit 36 is connected to the control system 1 and outputs the sound, such as a beep or the voice, in response to a sound control signal from the control system 1. In the present embodiment, similar to the display device 2, the sound output unit 36 is provided to the driving unit 321 of the machine body 30. The sound output unit 36 may integrally be provided with the display device 2.

The camera 38 has a function to capture a peripheral image of the machine body 30. The camera 38 is provided to the turning unit 32, for example, and is configured to be able to capture the image around (in at least one of the front, rear, left, right, up, and down directions of) the machine body 30. The image captured by the camera 38 may be any of a monochrome image, an infrared image, and a full-color image or may be a still image or a moving image. In the present embodiment, as an example, the camera 38 captures a full-color moving image (the peripheral image) behind the machine body 30, and outputs image data of the peripheral image to the control system 1 in real time.

The posture detection unit 39 has a function to detect a posture of each part of the machine body 30. For example, the posture detection unit 39 includes a boom angle sensor, an arm angle sensor, a bucket angle sensor, a machine body inclination sensor, a turning angular velocity sensor, and the like. The boom angle sensor detects a rotation angle (a boom angle) of the boom 332 with respect to the turning unit 32. The boom angle becomes the smallest when the boom 332 is lowered to the lowest position within a movable range thereof, and is increased as the boom 332 is lifted. The arm angle sensor detects a rotation angle (an arm angle) of the arm 333 with respect to the boom 332. The arm angle becomes the smallest when the arm 333 is folded most, and is increased as the arm 333 is extended by arm-out. The bucket angle sensor detects a rotation angle (a bucket angle) of the bucket 331 with respect to the arm 333. The bucket angle is the smallest when the bucket 331 is closed most, and is increased as the bucket 331 is opened. Each of these sensors is formed by any of or a combination of any of an acceleration sensor, a gyroscope sensor, a potentiometer, a stroke sensor, and a rotary encoder. The posture detection unit 39 outputs a detection result of the boom angle or the like to the control system 1 in real time.

The control system 1 is mainly configured as a computer system that has one or more processors such as a central processing unit (CPU) and one or more types of memory such as read only memory (ROM) and random access memory (RAM), and executes various types of processing (information processing). In the present embodiment, the control system 1 is an integrated controller that controls the entire work machine 3, and includes an electronic control unit (ECU), for example. However, the control system 1 may separately be provided from the integrated controller and may include the single processor or the plural processors as main components. A detailed description will be made on the control system 1 in the section "[3] Configuration of Control System".

The display device 2 is arranged in the driving unit 321 of the machine body 30, and is a user interface that accepts an operation input by the user (the operator) and outputs various types of information to the user. The display device 2 accepts any of various operations from the user by outputting an electrical signal that corresponds to the user's operation. In this way, the user (the operator) can visually recognize the display screen that is displayed on the display device 2, and can operate the display device 2 when necessary.

As illustrated in FIG. 2, the display device 2 includes a control unit 21, an operation unit 22, and a display unit 23. The display device 2 is configured to be communicable with the control system 1 and can exchange data with the control system 1. In the present embodiment, as an example, the display device 2 is a dedicated device used for the work machine 3.

The control unit 21 controls the display device 2 according to the data from the control system 1. More specifically, the control unit 21 outputs an electrical signal that corresponds to the user's operation accepted by the operation unit 22, and displays, on the display unit 23, the display screen that is generated by the control system 1.

The operation unit 22 is a user interface for accepting the operation input by the user (the operator) to the display screen that is displayed on the display unit 23. The operation unit 22 accepts various operations by the user by outputting an electrical signal that corresponds to the user's operation, for example. Examples of the operation unit 22 are a mechanical (push button) switch, a touchscreen, and an operation dial.

The display unit 23 is a user interface for presenting the information to the user (the operator), and examples thereof are a liquid-crystal display and an organic EL display, each of which displays various types of information. The display unit 23 presents various types of information to the user by means of display.

In addition to the above-described components, the machine body 30 includes a communication terminal, the fuel tank, a battery, and the like.

[2] Operation Device

Next, the detailed description will be made on the configuration of the operation device 35 with reference to FIG. 3. The operation device 35 includes the pair of the operation levers 351, 352 as described above.

Figure 3:
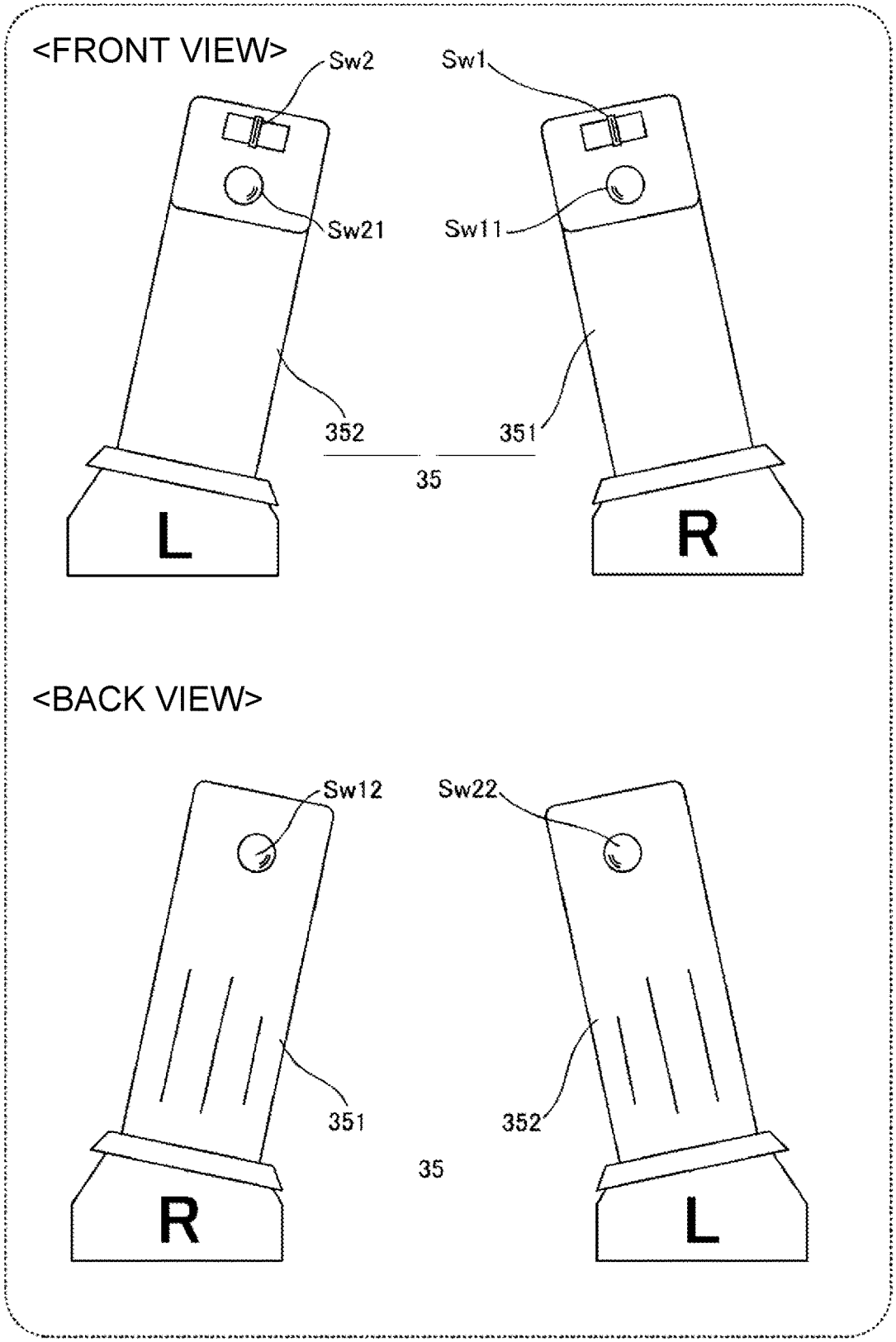
FIG. 3 includes schematic external views of an operation device for the work machine according to the first embodiment.

As illustrated in "FRONT VIEW" of FIG. 3, the operation lever 351 is located on a right hand side when seen from the operator who gets in the driving unit 321, and the operation lever 352 is located on a left hand side when seen from the operator who gets in the driving unit 321. Accordingly, the operator holds the operation lever 351 with his/her right hand and holds the operation lever 352 with his/her left hand, for example, and operates the pair of these operation levers 351, 352 to cause the various motions of the work machine 3. In the present embodiment, each of the paired operation levers 351, 352 is an example of a "first operation element" in the operation device 35.

Each of the operation levers 351, 352 is a stick-type operation element, is operated to be tilted to any of the "front", the "rear", the "left", and the "right" from a neutral position, for example, and thereby outputs the electrical signal (the operation signal) corresponding to the operation. As an example, the operation device 35 outputs the different operation signal in a manner to correspond to each of an operation to tilt the operation lever 351 to the front, an operation to tilt the operation lever 351 to the right, an operation to tilt the operation lever 352 to the front, and an operation to tilt the operation lever 352 to the right.

Furthermore, when at least one of the operation levers 351, 352 as the first operation elements is operated, the operation device 35 outputs the electrical signal (the operation signal) that corresponds to an operation amount (a tilt amount) of respective one of the operation levers 351, 352. In this way, as an example, in the case where it is assumed to make a bending motion of the arm 333 in correspondence with the operation to tilt the operation lever 352 to the rear (a near side), a driving speed of the arm 333 can be changed according to the operation amount (the tilt amount) of the operation lever 352. That is, as the operation amount (the tilt amount) of the operation lever 352 is increased, the flow rate of the hydraulic oil to the hydraulic cylinder 44 for driving the arm 333 is increased, and the driving speed of the arm 333 becomes high.

The operation device 35 includes plural mechanical switches Sw11, Sw12, Sw21, Sw22. The switch Sw11 is arranged on the front side of the operation lever 351, and the switch Sw12 is arranged on a back side of the operation lever 351. The switch Sw21 is arranged on the front side of the operation lever 352, and the switch Sw22 is arranged on a back side of the operation lever 352. That is, the present embodiment, the operation lever 351 on the right hand side is provided with the switch Sw11 and the switch Sw12 in a respectively separated manner to the front/back sides, and the operation lever 352 on the left hand side is provided with the switch Sw21 and the switch Sw22 in a respectively separated manner to the front/back sides. Each of these plural switches Sw11, Sw12, Sw21, Sw22 is an example of a "second operation element" in the operation device 35.

That is, the operation device 35 has the first operation elements (the operation levers 351, 352) and the second operation elements (the switches Sw11, Sw12, Sw21, Sw22). Here, the second operation element is an operation element that is operated in association with the operation of the first operation element. That is, the second operation element can be operated in a mode associated with the operation of the first operation element. However, the second operation element only needs to be operable at least in the mode associated with the operation of the first operation element, and any motion of the machine body 30 may be associated with the solo operation of the second operation element. In this case, the machine body 30 can make the certain motion by operating the second operation element alone.

More specifically, in the present embodiment, when the second operation element is operated simultaneously with the first operation element, the second operation element is operated in association with the operation of the first operation element. That is, in the case where the operator operates at least one of the first operation elements (the operation levers 351, 352) while operating at least one of the second operation elements (the switches Sw11, Sw12, Sw21, Sw22), the operator can operate the second operation element in association with the operation of the first operation element. Since the second operation element is operated in association with the operation of the first operation element, just as described, the machine body 30 can make the different motion from the motion in the case where the first operation element is operated alone.

However, the above description is not only applied to the case where the second operation element is operated simultaneously with the first operation element, and, as a timing to operate the second operation element, a certain duration may be set such as a timing immediately before or after the first operation element is operated. Just as described, even in the case where there is a time difference between an operation time point of the first operation element and an operation time point of the second operation element, it may be considered that the second operation element is operated in association with the operation of the first operation element, for example, when such a time difference between the operation time points falls within a predetermined time period.

In other words, in the case where the second operation element is operated during an operation acceptance period that is set with the operation time point of the first operation element being a reference, the second operation element is operated in association with the operation of the first operation element. Here, as an example, the operation acceptance period is a period from a time point, which is earlier than the operation time point of the first operation element by a first predetermined time, to a time point at which a second predetermined time elapses from the operation time point of the first operation element. In this way, when the operator operates the second operation element at the timing close to the operation time point of the first operation element with his/her intention of associating the operation of the second operation element with the operation of the first operation element, the operation of the second operation element can be accepted as being associated with the operation of the first operation element. Furthermore, in the case where both of the first predetermined time and the second predetermined time are set to zero, only the case where the second operation element is operated simultaneously with the first operation element can be accepted as the operation of the second operation element that is associated with the operation of the first operation element.

In the present embodiment, as an example, each of the plural switches Sw11, Sw12, Sw21, Sw22 is a momentary push button switch. Accordingly, in the case where the operator pushes any of the switches Sw11, Sw12, Sw21, Sw22, the operation device 35 outputs the electrical signal (the operation signal) indicating that respective one of the switches Sw11, Sw12, Sw21, Sw22 is operated only while the pushing operation continues.

Accordingly, for example, the operator can operate the switch Sw11 on the front side of the operation lever 351 with a first finger (a thumb) or the like of his/her right hand holding the operation lever 351, and can operate the switch Sw12 on the back side of the operation lever 351 with a second finger (an index finger) or the like of his/her right hand. Similarly, for example, the operator can operate the switch Sw21 on the front side of the operation lever 352 with a first finger (a thumb) or the like of his/her left hand holding the operation lever 352, and can operate the switch Sw22 on the back side of the operation lever 352 with a second finger (an index finger) or the like of his/her left hand.

Just as described, in the present embodiment, the second operation elements (the switches Sw11, Sw12, Sw21, Sw22) are arranged on the first operation elements (the operation levers 351, 352). Accordingly, the operator can operate the switches Sw11, Sw12, Sw21, Sw22 as the second operation elements with his/her hands operating the operation levers 351, 352 as the first operation elements, for example. Thus, the operator can easily operate the operation levers 351, 352 as the first operation elements simultaneously with the switches Sw11, Sw12, Sw21, Sw22 as the second operation elements.

The first operation elements include the operation levers 351, 352, and the second operation elements include the switches Sw11, Sw12, Sw21, Sw22. Thus, the operator can operate the operation levers 351, 352, which are included in the first operation elements, by tilting, and can operate the switches Sw11, Sw12, Sw21, Sw22, which are included in the second operation elements, by the pushing operation, for example. The operation mode differs between the first operation element and the second operation element, just as described. Accordingly, even in the case where the operator operates the first operation element and the second operation element simultaneously, for example, the operator is less likely to be confused with the operation of these elements, and thus operability is improved.

By the way, a corresponding relationship between the operations of the first operation elements (the operation levers 351, 352) and the motion of the machine body 30 is defined in the "first operation pattern", and the first operation pattern is stored in the memory of the control system 1, for example. Thus, for example, the first operation pattern defines which part of the machine body 30 makes what type of the motion in response to the tilting operation of the operation lever 352 to the rear (the near side), for example. Similarly, a corresponding relationship between the operations of the second operation elements (the switches Sw11, Sw12, Sw21, Sw22) and the motion of the machine body 30 is defined in a "second operation pattern", and the second operation pattern is stored in the memory of the control system 1, for example. Thus, for example, the second operation pattern defines which part of the machine body 30 makes what type of the motion in response to the pushing operation of the switch Sw11, for example. A detailed description on these first operation pattern and second operation pattern will be made below.

In the present embodiment, the operation device 35 also includes plural operation elements Sw1, Sw2 for separately operating the plural output ports (the PTO1 to the PTO 4) of the drive device. The operation element Sw1 is arranged on the front side of the operation lever 351, and the operation element Sw2 is arranged on the front side of the operation lever 352. These plural operation elements Sw1, Sw2 constitute "adjustment operation elements" for adjusting a magnitude of the power (the flow rate of the hydraulic oil) that is output from the drive device.

In the present embodiment, as an example, each of the plural operation elements Sw1, Sw2 is a lever switch that can be operated to be tilted to the right or left. In particular, each of the operation elements Sw1, Sw2 is a momentary switch that is tilted to the right or left only when being applied with an operation force, with a center of a movable range in the right-left direction D3 as a neutral position, and returns to the neutral position when the operation force is no longer applied. Each of such operation elements Sw1, Sw2 is operated to the right or left and thereby determines the magnitude of the power (the flow rate of the working oil), which is output from the corresponding outlet port, according to an operation amount (a tilt amount) thereof. Basically, as the operation amount of each of the operation elements Sw1, Sw2 is increased, the power output from the corresponding outlet port is increased, that is, the flow rate of the hydraulic oil is increased.

The operation levers 351, 352 may be arranged reversely on the right and left sides, or may be aligned in the front-rear direction D2 or the up-down direction D1. Only one of the operation levers 351, 352 may be provided. Furthermore, the arrangement of the plural switches Sw11, Sw21 is not limited to that on the front side of the operation levers 351, 352, and the plural switches Sw11, Sw21 may be arranged on lateral surfaces or the back side of the operation levers 351, 352, for example. The arrangement of the plural switches Sw12, Sw22 is not limited to that on the back side of the operation levers 351, 352, and the plural switches Sw12, Sw22 may be arranged on the lateral surfaces or the front side of the operation levers 351, 352, for example. Each of the plural switches Sw11, Sw12, Sw21, Sw22 is not limited to the mechanical push button switch, and may be a touch sensor, a lever switch, a toggle switch, a rocker switch, a rotary switch, a slide switch, or an encoder, for example.

Each of the operation elements Sw1, Sw2 is not limited to the lever switch, and may be a toggle switch, a rocker switch, a rotary switch, a slide switch, or an encoder, for example. In addition, the operation device 35 may have an operation element other than the plural switches Sw11, Sw12, Sw21, Sw22 and the operation elements Sw1, Sw2 described above on the operation levers 351, 352, and the operation elements Sw1, Sw2 can appropriately be omitted.

[3] Configuration of Control System

Next, a description will be made on the configuration of the control system 1 according to the present embodiment with reference to FIG. 2. The control system 1 controls each unit of the machine body 30 (including the travel unit 31, the turning unit 32, the work unit 33, and the like) in response to the operation on the operation device 35. In the present embodiment, the operation device 35 is mounted to the machine body 30 of the work machine 3 as described above. The control system 1 is a component of the work machine 3 and, together with the machine body 30 and the like, constitutes the work machine 3. In other words, the work machine 3 according to the present embodiment at least includes the control system 1 and the machine body 30.

As illustrated in FIG. 2, the control system 1 includes an acquisition processing unit 11, a control processing unit 12, a change processing unit 13, a setting processing unit 14, and a storage unit 15. In the present embodiment, as an example, the control system 1 has, as the main component, the computer system that has the one or more processors. Accordingly, when the one or more processors execute a work machine control program, these plural functional units (the acquisition processing unit 11 and the like) are provided. These plural functional units included in the control system 1 may separately be provided in plural casings or may be provided in a single casing.

The control system 1 is configured to be communicable with the device that is provided to each part of the machine body 30. That is, at least the display device 2, the main switch 34, the operation device 35, the sound output unit 36, the camera 38, the posture detection unit 39, the first control valves 491 to 494, the cutoff switch 371, and the like are connected to the control system 1. Accordingly, the control system 1 can control the display device 2, the sound output unit 36, the first control valves 491 to 494, and the like, and can acquire the electrical signal (the operation signal or the like) from each of the display device 2, the main switch 34, the operation device 35, and the cutoff switch 371. Being "communicable" described in the present disclosure means that the information (the data) can be exchanged either directly or indirectly via a communication network (a network), a relay, or the like by an appropriate communication method for wired communication or wireless communication (communication using a radio wave or light as a medium). Thus, the control system 1 may exchange the various types of the information (the data) with each of the devices either directly or indirectly via the relay or the like. As an example, the control system 1 and the device provided in each part of the machine body 30 can communicate with each other by the communication method such as a Controller Area Network (CAN).

The acquisition processing unit 11 executes acquisition processing to accept the operation on the operation device 35 for controlling the work machine 3. That is, when the operation device 35, which has the pair of the operation levers 351, 352, outputs the operation signal corresponding to the operation by the user (the operator), the acquisition processing unit 11 acquires the operation signal. In this way, the acquisition processing unit 11 can acquire the operation signal with the operation contents (the operation direction and the operation amount) of each of the operation levers 351, 352, such as the operation to tilt the right operation lever 351 to the front or the operation to tilt the left operation lever 352 to the front. Similarly, the acquisition processing unit 11 can acquire the operation signal with the operation content (on/off) of each of the plural switches Sw11, Sw12, Sw21, Sw22. The acquisition processing unit 11 is further configured to be able to acquire on/off of each of the main switch 34 and the cutoff switch 371.

The control processing unit 12 executes control processing to control the machine body 30 according to the operation of the operation device 35. In the control processing, the control processing unit 12 controls the travel unit 31, the turning unit 32, the work unit 33, and the like of the machine body 30. More specifically, the control processing unit 12 outputs the control signal to each of the first control valves 491 to 494 according to the operation of the operation device 35 acquired by the acquisition processing unit 11, and thereby controls the hydraulic actuators such as the hydraulic motors 43, 45 and the hydraulic cylinder 44.

Here, the control processing unit 12 executes the control processing according to the operation pattern. The "operation pattern" described in the present disclosure means a corresponding relationship between the operation of the operation device 35 and the motion of the machine body 30, and includes data on a combination of the operation of the operation device 35 and the motion of the machine body 30, and the like. That is, the control processing unit 12 enables the motion of the machine body 30 corresponding to the operation of the operation device 35 according to the corresponding relationship between the operation of the operation device 35 and the motion of the machine body 30, which is defined as the operation pattern.

In particular, the corresponding relationship between the operations of the first operation elements (the operation levers 351, 352) and the motion of the machine body 30 is defined in the "first operation pattern" of the operation patterns. Meanwhile, the corresponding relationship between the operations of the second operation elements (the switches Sw11, Sw12, Sw21, Sw22) and the motion of the machine body 30 is defined in the "second operation pattern" of the operation patterns. In other words, the "operation patterns" described in the present disclosure includes the "first operation pattern" related to the operation of the first operation element and the "second operation pattern" related to the operation of the second operation element. The control processing unit 12 enables the motion of the machine body 30 corresponding to the operation of the first operation element in the operation device 35 according to the corresponding relationship between the operation of the first operation element and the motion of the machine body 30, which is defined as the first operation pattern. Similarly, the control processing unit 12 enables the motion of the machine body 30 corresponding to the operation of the second operation element in the operation device 35 according to the corresponding relationship between the operation of the second operation element and the motion of the machine body 30, which is defined as the second operation pattern.

For example, in the certain first operation pattern, the operation to tilt the right operation lever 351 in the operation device 35 to the front is associated with the motion to lower the boom 332 in the machine body 30, and the operation to tilt the left operation lever 352 in the operation device 35 to the rear is associated with the motion to bend the arm 333 in the machine body 30. In this case, when the acquisition processing unit 11 accepts the operation to tilt the operation lever 351 to the front, the control processing unit 12 controls the first control valves 491 to 494 and drives the hydraulic cylinder 44 of the work unit 33 to lower the boom 332. Similarly, when the acquisition processing unit 11 accepts the operation to tilt the operation lever 352 to the rear, the control processing unit 12 controls the first control valves 491 to 494 and drives the hydraulic cylinder 44 of the work unit 33 to bend the arm 333.

The change processing unit 13 executes change processing to change the first operation pattern. That is, the first operation pattern that is used by the control processing unit 12 is not fixed but can appropriately be changed by the change processing unit 13. In the present embodiment, as an example, the plural first operation patterns are stored in the storage unit 15 of the control system 1 in advance. The change processing unit 13 selects, as a "current first operation pattern", one first operation pattern from these plural first operation patterns. Just as described, the change processing unit 13 sets the "current first operation pattern" by selecting one first operation pattern from the plural first operation patterns that are defined in advance. Accordingly, when the first operation pattern selected by the change processing unit 13 is switched among the plural first operation patterns, the "current first operation pattern" is switched. The control processing unit 12 follows the first operation pattern (the current first operation pattern) that is set by the change processing unit 13, and executes the control processing to control the machine body 30 according to the operation of the first operation elements (the operation levers 351, 352) in the operation device 35.

As an example, in a state where four of a "pattern A", a "pattern B", a "pattern C", and a "pattern D" are stored as the first operation patterns in the storage unit 15, the change processing unit 13 selects any of these "pattern A" to "pattern D" as the "current first operation pattern". Each of the "pattern A", the "pattern B", the "pattern C", and the "pattern D" is data on the corresponding relationship (the combination) between the operations of the first operation elements (the operation levers 351, 352) in the mutually different operation devices 35 and the motion of the machine body 30. For example, in the case where the change processing unit 13 selects the "pattern A" as the first operation pattern, the control processing unit 12 executes the control processing according to the "pattern A". Meanwhile, in the case where the change processing unit 13 selects the "pattern C" as the first operation pattern, the control processing unit 12 executes the control processing according to the "pattern C".

The setting processing unit 14 executes setting processing to set the second operation pattern in association with the first operation pattern. That is, similar to the first operation pattern, the second operation pattern that is used by the control processing unit 12 is not fixed but can appropriately be changed by the setting processing unit 14. In the present embodiment, as an example, the plural second operation patterns are stored in the storage unit 15 of the control system 1 in advance. The setting processing unit 14 selects, as a "current second operation pattern", one second operation pattern from these plural second operation patterns. Just as described, the setting processing unit 14 sets the "current second operation pattern" by selecting one second operation pattern from the plural second operation patterns that are defined in advance. Accordingly, when the second operation pattern selected by the setting processing unit 14 is switched among the plural second operation patterns, the "current second operation pattern" is switched. The control processing unit 12 follows the second operation pattern (the current second operation pattern) that is set by the setting processing unit 14, and executes the control processing to control the machine body 30 according to the operations of the second operation elements (the switches Sw11, Sw12, Sw21, Sw22) in the operation device 35.

Here, the setting processing unit 14 does not set the second operation pattern independently but sets the second operation pattern in association with the first operation pattern. That is, when the "current first operation pattern" is determined, the second operation pattern corresponding thereto is automatically set as the "current second operation pattern" by the setting processing unit 14. As a result, the second operation pattern suitable for the first operation pattern can be set.

The storage unit 15 includes a non-volatile storage device, such as a Hard Disk Drive (HDD) or a Solid State Drive HDD (SSD), that stores the various types of the information. The storage unit 15 stores (memorizes) a program such as the work machine control program. The work machine control program is recorded in and provided by a computer-readable non-transitory recording medium, for example, is read from the non-transitory recording medium by a reader of the control system 1, and is stored in the storage unit 15. The work machine control program may be provided to (downloaded in) the control system 1 from a server or the like via a telecommunication line and may be stored in the storage unit 15.

In addition, the storage unit 15 stores the plural first operation patterns (as the example, the "pattern A", the "pattern B", the "pattern C", and the pattern D"), which are candidates for the "current first operation pattern" set by the change processing unit 13, and the like. Furthermore, the storage unit 15 also stores the "current first operation pattern" that is set (selected) by the change processing unit 13. Moreover, the storage unit 15 also stores the "current second operation pattern" that is set (selected) by the setting processing unit 14.

[4] Work Machine Control Method

A description will hereinafter be made on an example of a control method for the work machine 3 (hereinafter simply referred to as a "control method") that is mainly executed by the control system 1 with reference to FIG. 4 to FIG. 8.

The control method according to the present embodiment is executed by the control system 1 that has the computer system as the main component, and thus, in other words, is embodied by the work machine control program (hereinafter simply referred to as a "control program"). That is, the control program according to the present embodiment is a computer program for causing the one or more processors to execute the control method. Such a control program may be executed by the control system 1 and the display device 2 in cooperation with each other, for example.

Here, the control method according to the present embodiment is a control method for the work machine 3 including the machine body 30 that makes the motion according to the operation of the operation device 35. In other words, the control system 1 according to the present embodiment is used for the work machine 3 including the machine body 30 that makes the motion according to the operation of the operation device 35. That is, in the present embodiment, the control processing unit 12 of the control system 1 executes the control processing to control the machine body 30 according to the operation of the operation device 35. In this way, the machine body 30 makes the motion according to the operation of the operation device 35.

In the case where a preset specific start operation for executing the control program is performed, the control system 1 executes the following various types of processing related to the control method. An example of the start operation is the start operation of the engine for the work machine 3, that is, an on operation of the main switch 34. Meanwhile, when a preset specific termination operation is performed, the control system 1 terminates the following various types of processing related to the control method. An example of the termination operation is an operation to stop the engine for the work machine 3, that is, an off operation of the main switch 34.

[4.1] Motion During Operation of Second Operation Element

First, a description will be made on the motion of the machine body 30 that corresponds to the operation of each of the switches Sw11, Sw12, Sw21, Sw22 as the second operation elements. Here, in particular, a description will be made on the motion of the machine body 30 not in the case where the second operation element is operated independently but in the case where the second operation element is operated in association with the operation of the first operation elements (the operation levers 351, 352).

Figure 4:
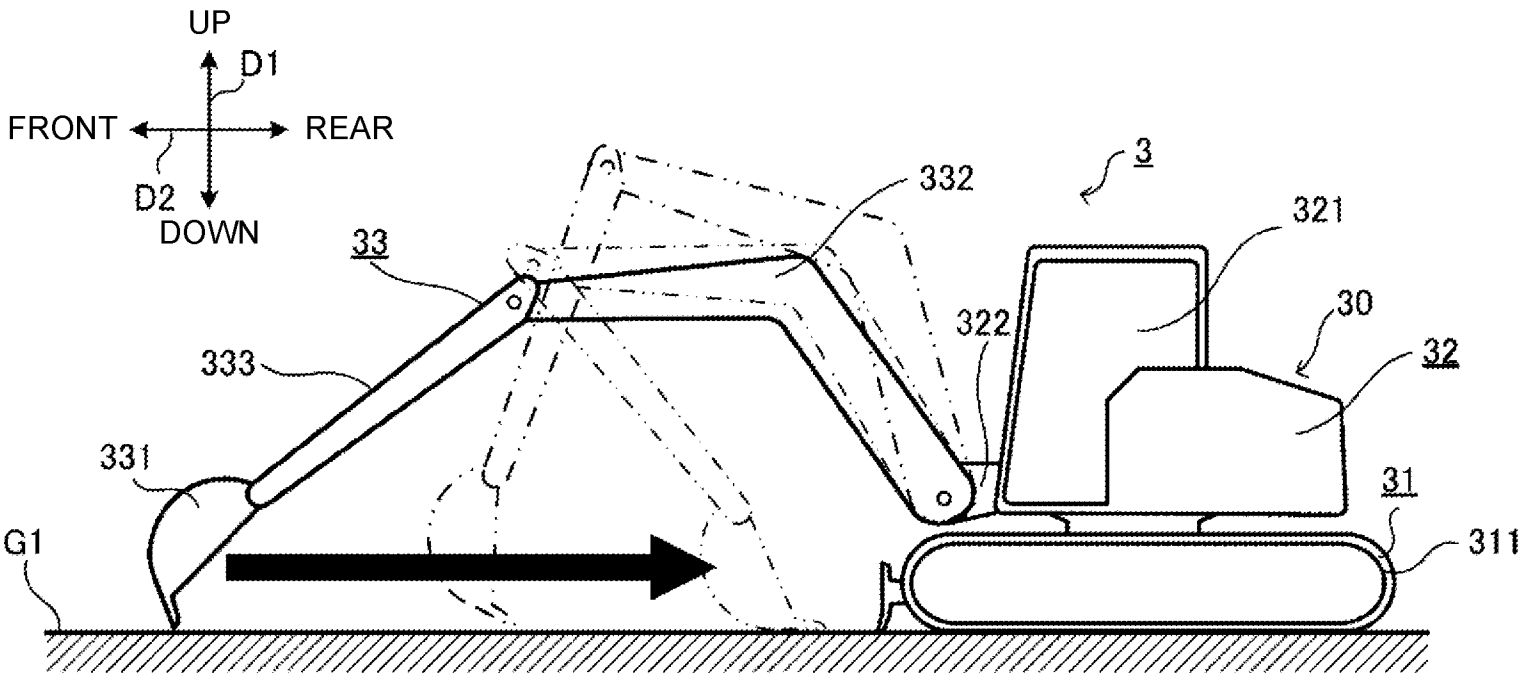
FIG. 4 is a schematic view illustrating an automatic ground leveling function of the work machine according to the first embodiment.

In the present embodiment, since the second operation element is operated in association with the operation of the first operation element, assistance control is executed to control the machine body 30 in a manner to assist with the motion of the machine body 30 that corresponds to the operation of the first operation element in the machine body 30. As an example, as illustrated in FIG. 4, by executing the assistance control, the work machine 3 performs automatic ground leveling to autonomously run the actuator of the work unit 33 such that teeth of the bucket 331 move along a target route that is based on a target working surface G1.

That is, the work machine 3 according to the present embodiment has a function (an automatic ground leveling function) to assist with a manual operation of the work machine 3 by the operator by autonomously running the actuator. More specifically, when the operator performs the operation to bend (close) the arm 333 by manually operating the first operation elements (the operation levers 351, 352) while performing the pushing operation of the second operation element, the control processing unit 12 controls at least one of the boom 332 and the bucket 331 such that the target route on the target working surface G1 and positions of the teeth of the bucket 331. In this way, for example, simply by operating the operation levers 351, 352 in a direction to bend the arm 333, the operator can make the reduction motion of the work unit 33 while making the teeth of the bucket 331 match the target route (the target working surface G1).

Here, in the case where the target working surface G1 is a horizontal surface (a flat surface) that is formed by leveling work, "automatic leveling" is executed by the automatic ground leveling function. In addition, the target working surface G1 is not limited to the horizontal surface, and may be a slope or the like that is formed by slope finishing work, for example. In this case, the work machine 3 moves the teeth of the bucket 331 along the slope as the target working surface G1. Furthermore, not only in the bending motion of the arm 333 but also in an extending motion of the arm 333, the work machine 3 can execute the assistance control for the autonomous motion of at least one of the boom 332 and the bucket 331. In this way, the work machine 3 can make the deployment motion of the work unit 33 while making the teeth of the bucket 331 match the target route (the target working surface G1).

Just as described, in the control method according to the present embodiment, when the second operation element is operated in association with the operation of the first operation element, the assistance control is executed to control the machine body 30 in the manner to assist with the motion of the machine body 30 that corresponds to the operation of the first operation element. Accordingly, the control of the machine body 30, which is executed together with the manual operation of the first operation element by the operator, can be executed by the operation of the second operation element. As a result, for example, at least one of the boom 332 and the bucket 331 makes the motion automatically while the arm 333 makes the motion in conjunction with the operation of the first operation element by the operator. In this way, semi-automatic control such as the "automatic leveling" can easily be executed.

More specifically, the machine body 30 has the work unit 33 that includes the arm 333, the boom 332, and the attachment (the bucket 331). Here, in the control method according to the present embodiment, the arm 333 is controlled by the operation of the first operation element, and at least one of the boom 332 and the attachment (the bucket 331) is controlled by the operation of the second operation element. In this way, simply by operating the first operation element by the operator to cause the arm 333 to make the motion, the semi-automatic control such as the "automatic leveling" can be executed.

[4.2] First Operation Pattern

Next, a description will be made on the first operation pattern that indicates the corresponding relationship between the operation of the first operation element and the motion of the machine body 30.

Figure 5:
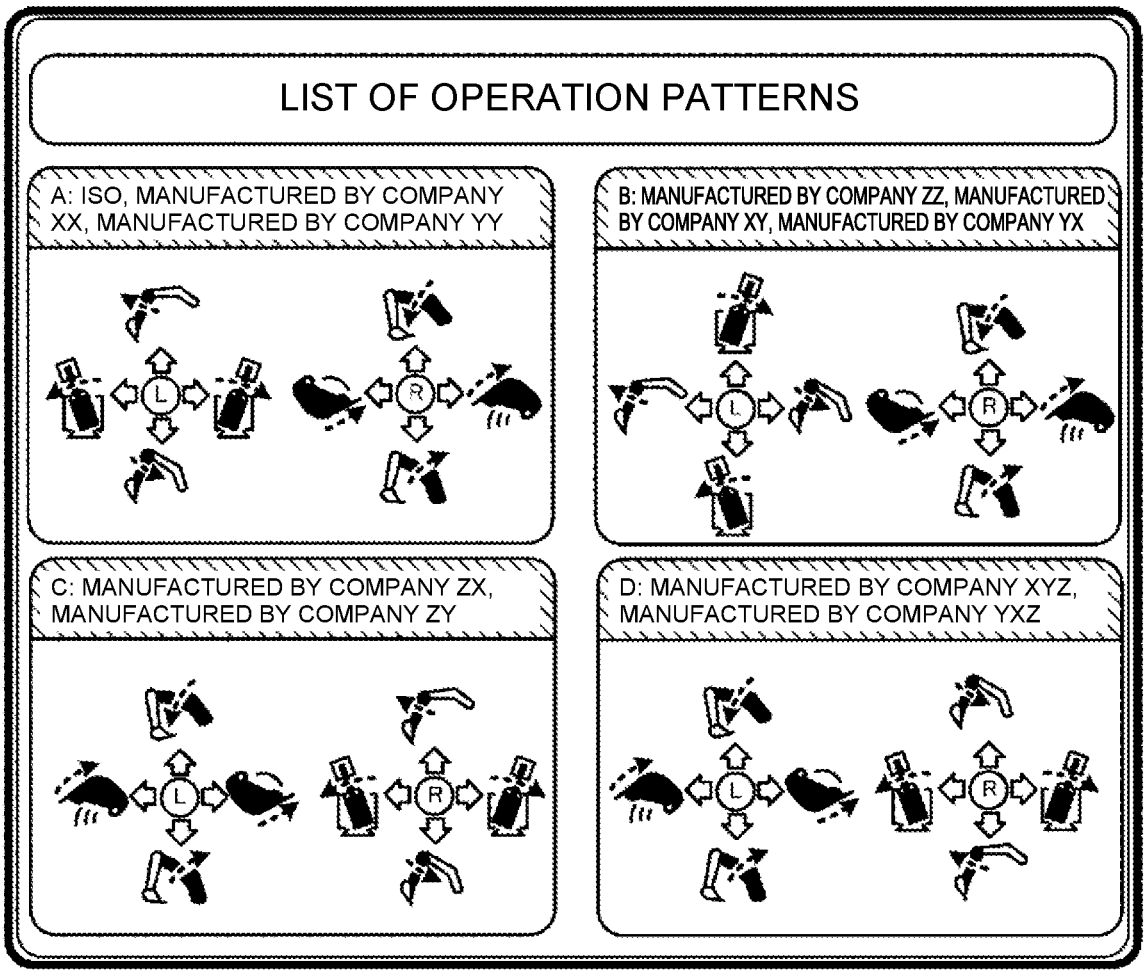
FIG. 5 is a schematic view illustrating an example of a first operation pattern of the work machine according to the first embodiment.

In the present embodiment, as an example, four of the "pattern A", the "pattern B", the "pattern C", and the "pattern D" exemplified in FIG. 5 are stored as the first operation patterns in the storage unit 15, and the change processing unit 13 selects (sets) any first operation pattern from these four patterns. In the example illustrated in FIG. 5, the first operation pattern for "ISO, manufactured by company XX, manufactured by company YY" is prepared as the "pattern A", the first operation pattern for "manufactured by company ZZ, manufactured by company XY, manufactured by company YX" is prepared as the "pattern B", the first operation pattern for "manufactured by company ZX, manufactured by company YZ" is prepared as the "pattern C", and the first operation pattern for "manufactured by XYZ company, manufactured by YXZ company" is prepared as the "pattern D".

FIG. 5 schematically illustrates a combination of the operation direction of each of the paired operation levers 351, 352 as the first operation elements and the motion of the machine body 30 for each of the "pattern A", the "pattern B", the "pattern C", and the "pattern D".

For example, in the "pattern A", the operation to tilt the right operation lever 351 to the front is associated with the motion to lower the boom 332 in the machine body 30, the operation to tilt the operation lever 351 to the rear is associated with the motion to lift the boom 332 in the machine body 30, the operation to tilt the operation lever 351 to the right is associated with the motion to open the bucket 331 in the machine body 30, and the operation to tilt the operation lever 351 to the left is associated with the motion to close (for excavation by) the bucket 331 in the machine body 30. Furthermore, in the "pattern A", the operation to tilt the left operation lever 352 to the front is associated with the motion to extend the arm 333 in the machine body 30, the operation to tilt the operation lever 352 to the rear is associated with the motion to bend the arm 333 in the machine body 30, the operation to tilt the operation lever 352 to the right is associated with the motion to make a right turn by the turning unit 32 in the machine body 30, and the operation to tilt the operation lever 352 to the left is associated with the motion to make a left turn by the turning unit 32 in the machine body 30.

Meanwhile, in the pattern "B", the operation to tilt the left operation lever 352 to the front is associated with the motion to make the right turn of the turning unit 32 in the machine body 30, the operation to tilt the operation lever 352 to the rear is associated with the motion to make the left turn of the turning unit 32 in the machine body 30, the operation to tilt the operation lever 352 to the right is associated with the motion to bend the arm 333 in the machine body 30, and the operation to tilt the operation lever 352 to the left is associated with the motion to extend the arm 333 in the machine body 30.

Just as described, the motion of the machine body 30 that corresponds to the certain operations of the first operation elements (the operation lever 351, 352) differs by the selected first operation pattern. In other words, the operations of the first operation elements (the operation lever 351, 352) for generating the same motion of the machine body 30 differ by the selected first operation pattern.

Next, a detailed description will be made on a specific processing example that is particularly related to change of the first operation pattern in the control method according to the present embodiment.

In the present embodiment, as described above, the change processing unit 13 of the control system 1 executes the change processing to change the first operation pattern, and can thereby change the first operation pattern that is the corresponding relationship between the operation of the first operation element and the motion of the machine body 30. Here, the first operation pattern is set (changed) according to the operation by the operator (the user). That is, when the operator selects an appropriate pattern from the "pattern A", the "pattern B", the "pattern C", and the "pattern D", the current first operation pattern is changed.

Figure 6:
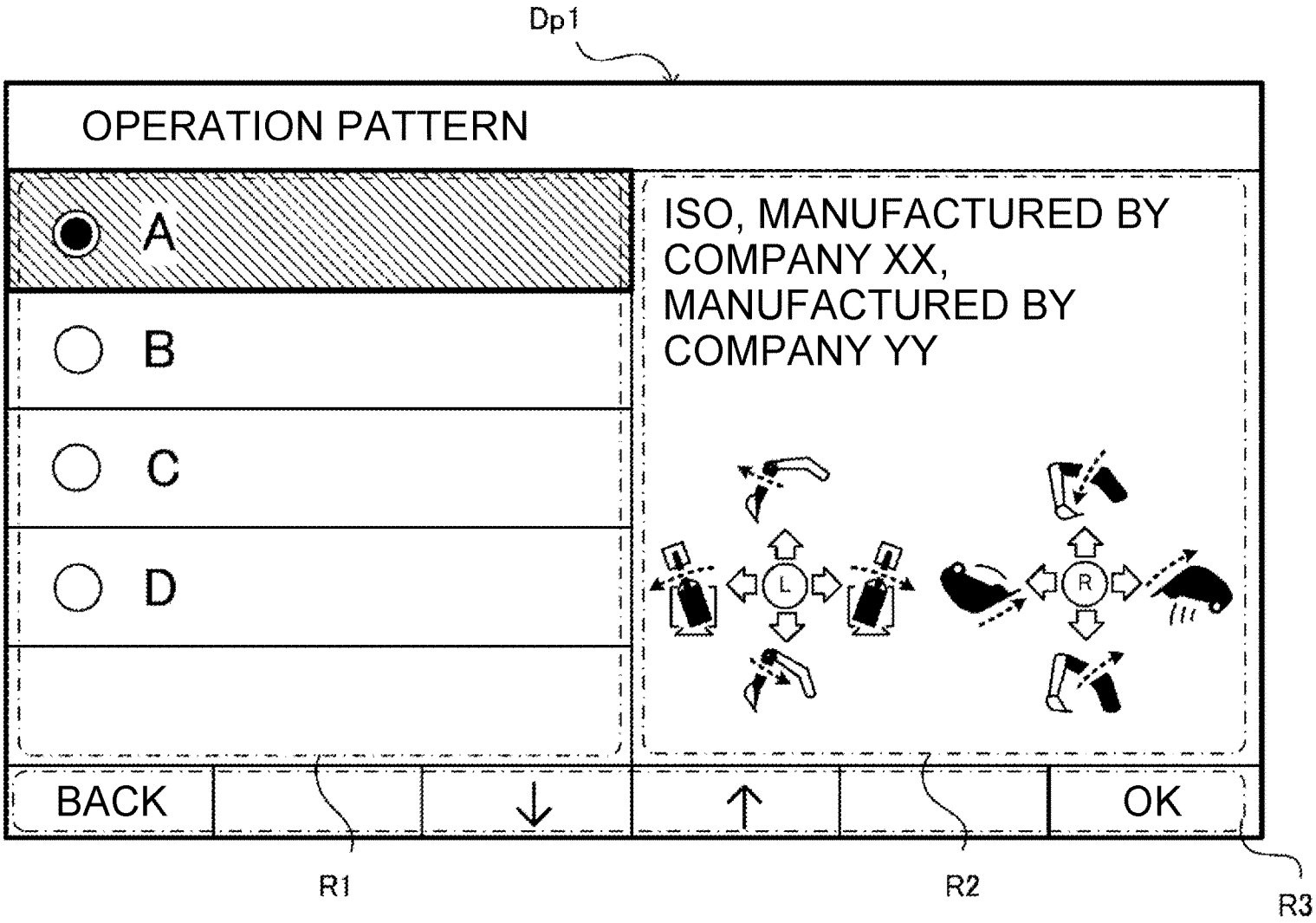
FIG. 6 is a view illustrating an example of a change screen that is displayed by a work machine control system according to the first embodiment.

More specifically, as illustrated in FIG. 6, the change processing unit 13 has a function to display, on the display device 2, a change screen Dp1 for changing the first operation pattern. The operation pattern that is selected on the change screen Dp1 is set as the "current first operation pattern" by the change processing unit 13. Thus, while visually checking the first operation pattern on the display device 2, the operator can determine the first operation pattern that is the corresponding relationship between the operation of the first operation elements (the operation levers 351, 352) and the motion of the machine body 30.

As an example, as illustrated in FIG. 6, the change screen Dp1 has a first area R1, a second area R2, and a third area R3. In the third area R3, items of "up" and "down" cursors, an item of "BACK" for returning to a previous screen, and an item of "OK" are displayed. In the first area R1, the "pattern A", the "pattern B", the "pattern C", and the "pattern D" as options of the first operation pattern are displayed. In the first area R1, any one of the "pattern A", the "pattern B", the "pattern C", and the "pattern D" is highlighted. The highlighted pattern is switched by an operation of the cursor in the third area R3. Furthermore, a radio button is associated with each of the "pattern A", the "pattern B", the "pattern C", and the "pattern D", and the radio button corresponding to the selected pattern is in an "on" state. In the example illustrated in FIG. 6, the "pattern A" is highlighted, and the "pattern A" is selected as the first operation pattern.

In the second area R2, detailed information on the highlighted first operation pattern is displayed as changed pattern information. In the example illustrated in FIG. 6, detailed information on the highlighted "pattern A" is displayed in the second area R2. Here, the detailed information as the changed pattern information includes an image (an icon) indicating the corresponding relationship between the operation of the first operation element and the motion of the machine body 30. More specifically, the detailed information includes the text "ISO, manufactured by company XX, manufactured by company YY" and the image indicating the combination between the operation direction of each of the paired operation levers 351, 352 and the motion of the machine body 30.

Figure 7:
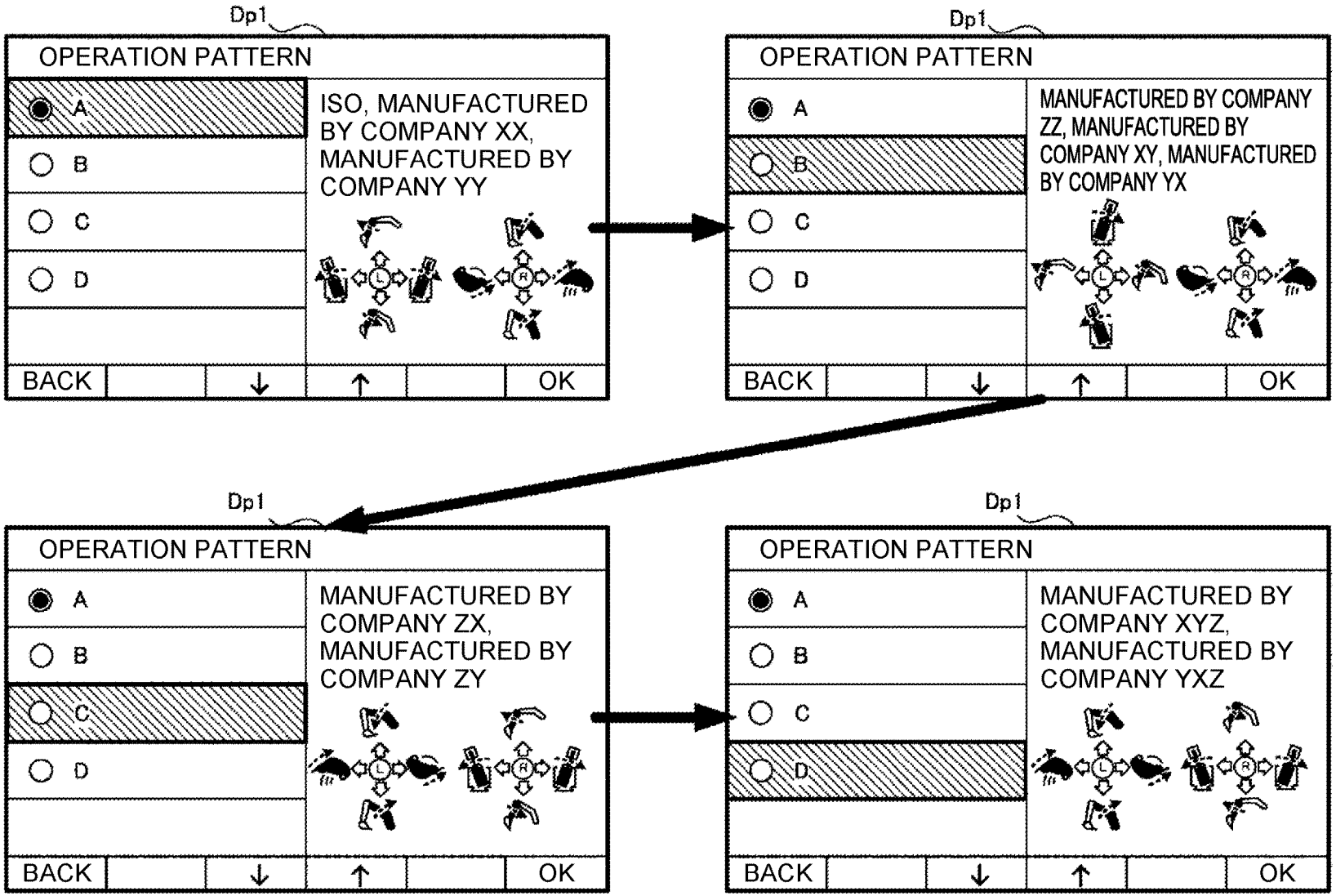
FIG. 7 is a conceptual view illustrating a transition state of the change screen that is displayed by the work machine control system according to the first embodiment.

According to such a change screen Dp1, as illustrated in FIG. 7, the highlighted pattern is switched by the operation of the cursor in the third area R3. Along with this, the detailed information that is displayed in the second area is also switched to the detailed information on the highlighted pattern. Accordingly, the operator can select the desired pattern by operating the item of "OK" in the state where the desired pattern is highlighted.

[4.3] Second Operation Pattern

Next, a description will be made on the second operation pattern that indicates the corresponding relationship between the operation of the second operation element and the motion of the machine body 30.

In the present embodiment, the motion of the machine body 30 that corresponds to a certain operation of the second operation element (the switches Sw11, Sw12, Sw21, or Sw22) differs by the set second operation pattern. In other words, the second operation pattern defines to which of the switches Sw11, Sw12, Sw21, Sw22 as the second operation elements the operation to execute the assistance control (the automatic ground leveling function) for the machine body 30 is assigned.

Here, in the control method according to the present embodiment, the setting processing unit 14 executes the setting processing to set the second operation pattern in association with the first operation pattern. That is, the second operation pattern is set in association with the first operation pattern. Accordingly, when the "current first operation pattern" is determined, the second operation pattern corresponding thereto is automatically set as the "current second operation pattern" by the setting processing unit 14.

As an example, in the case where the first operation pattern is the "pattern A" or the "pattern B", the operation to execute the assistance control (the automatic ground leveling function) for the machine body 30 in the second operation pattern is assigned to the switch Sw21. Meanwhile, in the case where the first operation pattern is the "pattern C" or the "pattern D", the operation to execute the assistance control (the automatic ground leveling function) for the machine body 30 in the second operation pattern is assigned to the switch Sw11.

In short, in the "pattern A" or the "pattern B", the left operation lever 352 is the first operation element for manually operating the arm 333 by the operator in the automatic ground leveling function. Accordingly, the operation to implement the automatic ground leveling function is assigned to the switch Sw21 that is provided on the operation lever 352. In this way, the operator can perform the automatic ground leveling by operating the operation lever 352 for the motion of the arm 333 while pushing the switch Sw21 on the operation lever 352. As a result, the operator can complete the operation for the automatic ground leveling with the one operation lever 352, which simplifies the required operation.

Similarly, in the "pattern C" or the "pattern D", the right operation lever 351 is the first operation element for manually operating the arm 333 by the operator in the automatic ground leveling function. Accordingly, the operation to implement the automatic ground leveling function is assigned to the switch Sw11 that is provided on the operation lever 351. In this way, the operator can perform the automatic ground leveling by operating the operation lever 351 for the motion of the arm 333 while pushing the switch Sw11 on the operation lever 351. As a result, the operator can complete the operation for automatic ground leveling with the one operation lever 351, which simplifies the required operation.

As another example, in the case where the first operation pattern is the "pattern A", the operation to implement the automatic ground leveling function is assigned to the switch Sw22. In the case where the first operation pattern is the "pattern B", the operation to implement the automatic ground leveling function is assigned to the switch Sw21. Meanwhile, in the case where the first operation pattern is the "pattern C", the operation to implement the automatic ground leveling function is assigned to the switch Sw12. In the case where the first operation pattern is the "pattern D", the operation to implement the automatic ground leveling function is assigned to the switch Sw11.

In short, as in the "pattern A" or the "pattern C", in the case where the motion to bend the arm 333 is associated with the operation to tilt the operation lever 351 or 352 to the rear (the near side), the operation to implement the automatic ground leveling function is preferably assigned to the switch Sw12 or Sw22 provided to be easily operable on the back side, respectively. Meanwhile, as in the "pattern D", in the case where the motion to bend the arm 333 is associated with the operation to tilt the operation lever 351 to the front, the operation to implement the automatic ground leveling function is preferably assigned to the switch Sw11 provided to be easily operable on the front side.

That is, the control method according to the present embodiment includes: changing the first operation pattern; and setting the second operation pattern in association with the first operation pattern. Here, the first operation pattern is the corresponding relationship between the operation of the first operation element in the operation device 35 and the motion of the machine body 30, and the second operation pattern is the corresponding relationship between the operation of the second operation element, which is performed in association with the operation of the first operation element, in the operation device 35 and the motion of the machine body 30.

Since the "current second operation pattern" that corresponds to the "current first operation pattern" is set, just as described, it is possible to execute the control method for the work machine 3 easily reducing an operation burden on the operator. That is, in the case where the first operation pattern, which is the corresponding relationship between the operations of the first operation elements (the operation lever 351, 352) and the motion of the machine body 30, is changed, the second operation pattern corresponding to the changed first operation pattern is automatically set, and thus the second operation pattern suitable for the first operation pattern can be adopted. As a result, for example, the operator is no longer required to perform a complicated operation to push the switches Sw21, Sw22 on the operation lever 352 while operating the operation lever 351. Thus, such an operation error that the unintentional operation of the operation lever 352 causes the motion of the boom 332 or the like is less likely to occur. This results in an advantage that it is easy to reduce the operation burden on the operator.

In the present embodiment, in particular, the second operation pattern is automatically changed in conjunction with the change of the first operation pattern. In short, when the change processing unit 13 changes the first operation pattern, the setting processing unit 14 automatically changes the second operation pattern in the manner to correspond to the changed first operation pattern. In this way, the second operation pattern that is suitable for the first operation pattern is always set for the operator without intentionally changing the second operation pattern.

[4.4] Overall Processing

Figure 8:
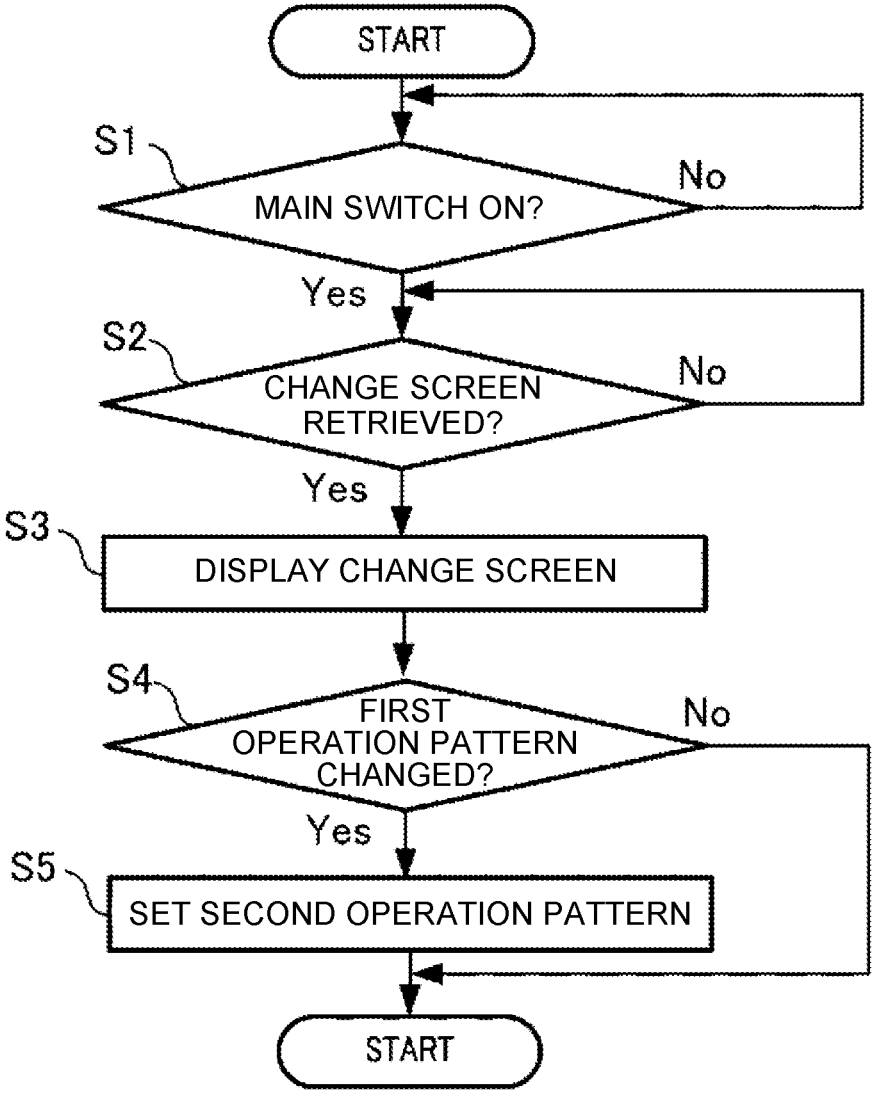
FIG. 8 is a flowchart illustrating an operation example of the work machine control system according to the first embodiment.

Next, a description will be made on an overall flow of the processing related to the control method with reference to FIG. 8. FIG. 8 is a flowchart illustrating an example of the processing related to the control method.

As illustrated in FIG. 8, first, the control system 1 determines whether the main switch 34 has been turned on (S1). If the main switch 34 has been turned on (S1: Yes), the control system 1 determines whether an operation to retrieve the change screen Dp1 has been performed (S2). More specifically, if the change processing unit 13 has performed the operation to retrieve the change screen Dp1 on a home screen or the like (S2: Yes), the processing proceeds to step S3. If the change processing unit 13 has not performed the operation to retrieve the change screen Dp1 (S2: No), the control system 1 continues to determine whether the operation to retrieve the change screen Dp1 has been performed (S2).

In step S3, the change processing unit 13 causes the display unit 23 of the display device 2 to display, as the display screen, the change screen Dp1 for changing the first operation pattern. While the change screen Dp1 is displayed, the change processing unit 13 in the control system 1 sets the desired pattern as the "current first operation pattern" according to the operation by the operator (the user). The control system 1 determines whether the first operation pattern has been changed (S4). If the operation to change the first operation pattern has been performed on the change screen Dp1 (S4: Yes), the processing proceeds to step S5. If the operation to change the first operation pattern has not been performed (S4: No), the processing in step S5 is skipped, and the control system 1 terminates a series of the processing.

In step S5, the setting processing unit 14 sets the second operation pattern. At this time, the setting processing unit 14 automatically sets the second operation pattern that corresponds to the changed first operation pattern.

The control system 1 repeatedly executes the processing in steps S1 to S5 described above. However, the flowchart illustrated in FIG. 8 is merely one example. Processing may appropriately be added or omitted, or an order of the processing may appropriately be changed.

[5] Modified Examples

A description will hereinafter be made on modified examples of the first embodiment. The modified examples, which will be described below, can appropriately be combined and implemented.

The control system 1 in the present disclosure includes the computer system. The computer system has, as the main components, the one or more processors as hardware and the one or more types of the memory. When the processor executes the program that is stored in the memory of the computer system, the function as the control system 1 in the present disclosure is implemented. The program may be recorded in the memory of the computer system in advance, may be provided through the telecommunication line, or may be provided in a manner to be recorded in the non-transitory recording medium, such as a memory card, an optical disk, or a hard disk drive, each of which is readable by the computer system. Furthermore, some or all of the functional units included in the control system 1 may be configured as an electronic circuit.

The configuration that at least some of the functions of the control system 1 are integrated in the single casing is not essential, and the components of the control system 1 may separately be provided in the plural casings. On the contrary, the functions that are separately provided in the plural devices (for example, the control system 1 and the display device 2) in the first embodiment may be integrated in the single casing. Furthermore, at least some of the functions of the control system 1 may be implemented by a cloud (cloud computing) or the like.

The power source of the work machine 3 is not limited to the diesel engine. For example, the power source of the work machine 3 may be the engine other than the diesel engine, may be a motor (an electric motor), or may be a hybrid power source that includes the engine and the motor (the electric motor).

The display device 2 is not limited to the dedicated device, but may be a general-purpose terminal, such as a laptop computer, a tablet terminal, or a smartphone. Furthermore, the mode of the display unit 23 is not limited to the mode in which the display screen is directly displayed like the liquid-crystal display or the organic EL display. Like a projector, the display unit 23 may be configured to display the display screen by projection, for example.

As the information input mode of the operation unit 22, the mode other than the push-button switch, the touchscreen, and the operation dial may be adopted. For example, the operation unit 22 may adopt an input mode using a keyboard or a pointing device such as a mouse, a voice input mode, a gesture input mode, an input mode of an operation signal from another terminal, or the like.

The present invention is not limited to the configuration that the operation device 35, the display device 2, and the like are mounted on the machine body 30. For example, the operation device 35, the display device 2, and the like may separately be provided from the machine body 30. In this case, the operation device 35, the display device 2, and the like are configured to be communicable with the machine body 30 and enable a remote operation of the machine body 30.

That the first operation pattern set by the change processing unit 13 is selected from the plural patterns as the options is not essential, and the first operation pattern may freely be customized by the operator (the user). More specifically, for example, on the change screen Dp1, the operator separately specifies the motion of the machine body 30 to be associated with the operation of each of the operation levers 351, 352, and thereby freely customizes the first operation pattern.

The setting processing unit 14 only needs to set the second operation pattern in association with the first operation pattern. Thus, the corresponding relationship between the second operation pattern and the first operation pattern is not limited to the above-described example. The operator may freely customize which second operation pattern is associated with the first operation pattern.

Second Embodiment

A control method according to the present embodiment differs from the control method according to the first embodiment in the motion of the machine body 30 that corresponds to the operation of the second operation element. Hereinafter, the same components as those in the first embodiment will be denoted by the same reference signs, and the description thereon will appropriately be omitted.

Figure 9:
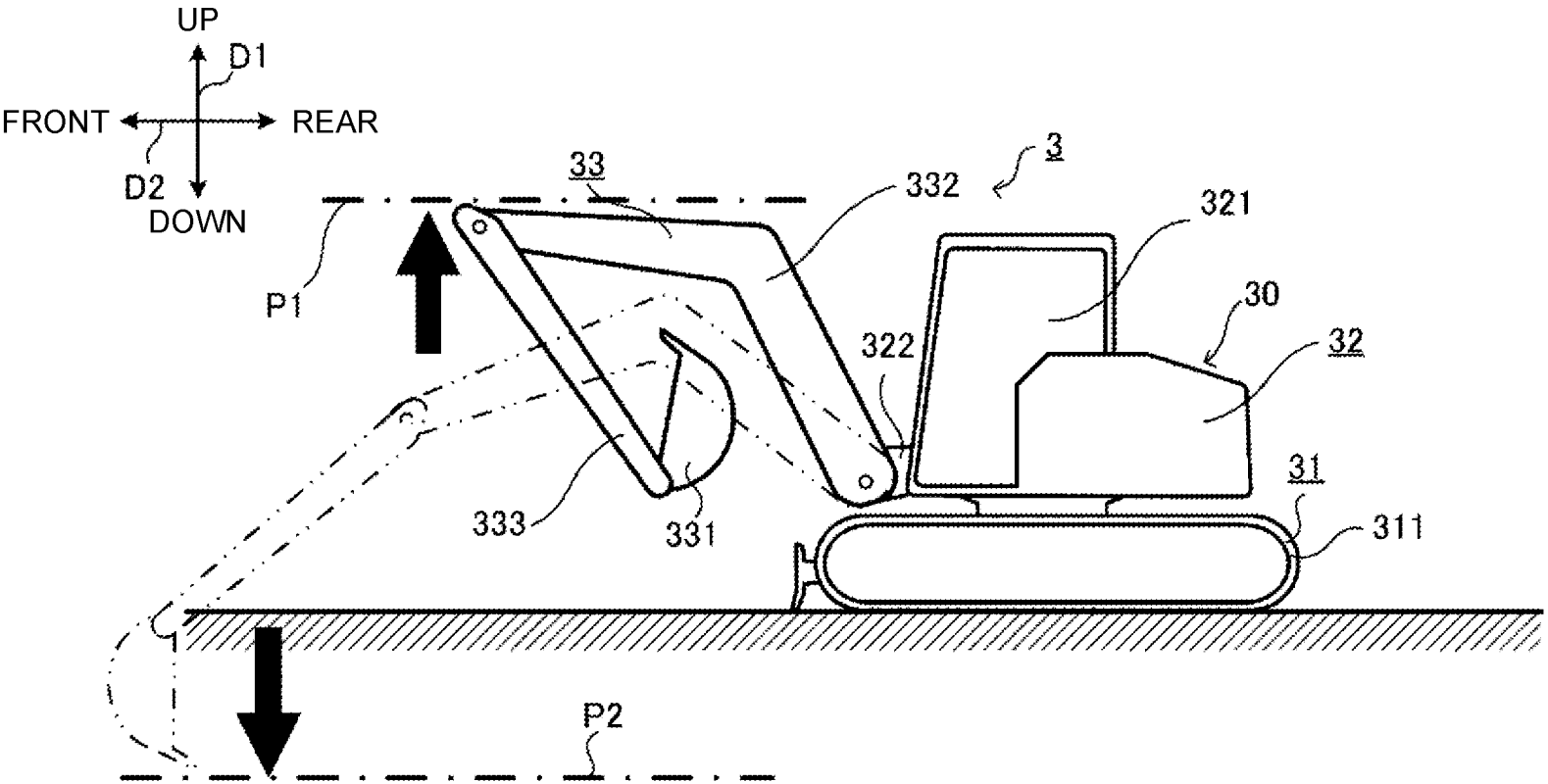
FIG. 9 is a schematic view illustrating movable range registration action for a work unit of a work machine according to a second embodiment.

In the present embodiment, as illustrated in FIG. 9, the operation of the second operation element is associated with movable range registration action of the work unit 33. That is, for example, as illustrated in FIG. 9, in the case where the movable range of the work unit 33 in the up-down direction D1 is registered, a movable range of the boom 332 is limited.

Accordingly, the operator performs the operation to lift the boom 332, and then pushes the second operation element (the switches Sw11, Sw12, Sw21, or Sw22). In this way, the operator can register the position of the boom 332 during the pushing operation of the second operation element as an upper end of the movable range, that is, a height limit position P1 of the work unit 33. In addition, the operator performs the operation to lower the boom 332, and then pushes the second operation element (the switches Sw11, Sw12, Sw21, or Sw22). In this way, the operator can register the position of the boom 332 during the pushing operation of the second operation element as a lower end of the movable range, that is, a depth limit position P2 of the work unit 33.

As an example, in the case where the first operation pattern is the "pattern A" or the "pattern B", in the second operation pattern, the operation to register the movable range of the work unit 33 is assigned to the switch Sw11. Meanwhile, in the case where the first operation pattern is the "pattern C" or the "pattern D", in the second operation pattern, the operation to register the movable range of the work unit 33 is assigned to the switch Sw21.

In short, in the "pattern A" or the "pattern B", when the movable range of the work unit 33 is registered, the right operation lever 351 is the first operation element for manually operating the boom 332 by the operator. Accordingly, the operation to register the movable range of the work unit 33 is assigned to the switch Sw11 that is provided on the operation lever 351. In this way, by pushing the switch Sw11 of the operation lever 351, the operator can register the position of the boom 332 at the time point as the upper end or the lower end of the movable range. As a result, the operator can complete the operation to register the movable range of the work unit 33 with the one operation lever 351, which simplifies the required operation.

Similarly, in the "pattern C" or the "pattern D", when the movable range of the work unit 33 is registered, the left operation lever 352 is the first operation element for manually operating the boom 332 by the operator. Accordingly, the operation to register the movable range of the work unit 33 is assigned to the switch Sw21 that is provided on the operation lever 352. In this way, by pushing the switch Sw21 on the operation lever 352, the operator can register the position of the boom 332 at the time point as the upper end or the lower end of the movable range. As a result, the operator can complete the operation to register the movable range of the work unit 33 with the one operation lever 352, which simplifies the required operation.

Figure 10:
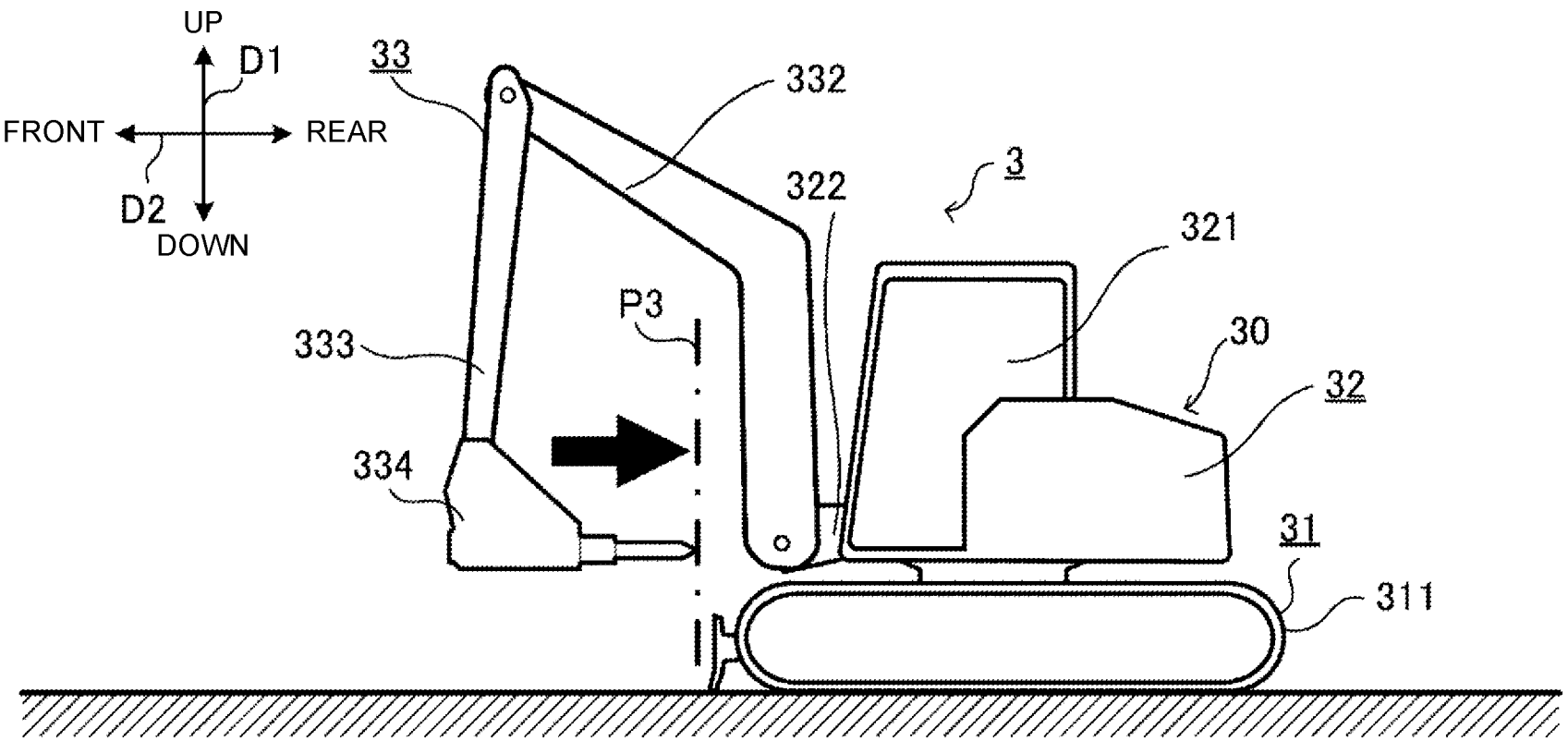
FIG. 10 is a schematic view illustrating the movable range registration action for the work unit of the work machine according to the second embodiment.

In the present embodiment, as illustrated in FIG. 10, for example, when the breaker 334 or the like is attached as the attachment, the operation of the second operation element is also associated with registration action of a winding limit position P3. That is, for example, as illustrated in FIG. 10, in the case where the breaker 334 or the like is attached, a limit position in a bending direction of the arm 333 may be registered as the winding limit position P3 in order to avoid interference of the breaker 334. In this case, the operator performs the bending operation of the arm 333, and then pushes the second operation element (the switches Sw11, Sw12, Sw21, or Sw22). In this way, the operator can register the position of the arm 333 during the pushing operation of the second operation element as the winding limit position P3.

In this case, as an example, in the case where the first operation pattern is the "pattern A" or the "pattern B", in the second operation pattern, the operation to register the winding limit position P3 is assigned to the switch Sw21. Meanwhile, in the case where the first operation pattern is the "pattern C" or the "pattern D", in the second operation pattern, the operation to register the winding limit position P3 is assigned to the switch Sw11.

As further another example of the present embodiment, the motion of the machine body 30 that corresponds to the operation of the second operation element may be the motion of each of the plural output ports (the PTO1 to the PTO4) of the drive device. As an example, when wood as a work target is grasped, any (for example, the PTO1) of the output ports has to be driven together with the arm 333 in the work machine 3 such as a harvester. In this case, in the second operation pattern, the plural output ports (the PTO1 to the PTO4) in the drive device are assigned to the plural operation elements Sw1, Sw2, each of which is provided to separately operate the output port, as the examples of the second operation elements. Thus, the second operation pattern is preferably set such that the output port (for example, the PTO1) is assigned to the operation elements Sw1, Sw2, which are respectively provided on the operation levers 351, 352 for operating the arm 333, of the plural operation elements Sw1, Sw2.

Any of the various configurations (including the modified examples) that have been described in the second embodiment can be adopted in appropriate combination with any of the various configurations (including the modified examples) that have been described in the first embodiment.

SUPPLEMENTARY NOTES OF THE INVENTION

A description will hereinafter be made on the summary of the invention that is extracted from the above-described embodiment. The components and the processing functions, which will be described in the following supplementary notes, can be selected, omitted, or combined as desired.

<Supplementary Note 1>

The control method for the work machine including the machine body that makes the motion according to the operation of the operation device, the work machine control method includes:

changing the first operation pattern as the corresponding relationship between the operation of the first operation element in the operation device and the motion of the machine body; and setting the second operation pattern in association with the first operation pattern, the second operation pattern being the corresponding relationship between the operation of the second operation element in the operation device, which is performed in association with the operation of the first operation element, and the motion of the machine body.

<Supplementary Note 2>

The work machine control method according to Supplementary Note 1, in which the second operation pattern is automatically changed in conjunction with the change of the first operation pattern.

<Supplementary Note 3>

The work machine control method according to Supplementary Note 1 or 2, in which the second operation element is arranged to the first operation element.

<Supplementary Note 4>

The work machine control method according to any one of Supplementary Note 1 to 3, in which when the second operation element is operated in the operation acceptance period with the operation time point of the first operation element being the reference, the second operation element is operated in association with the operation of the first operation element.

<Supplementary Note 5>

The work machine control method according to any one of Supplementary Note 1 to 4, in which the first operation element includes the operation lever, and the second operation element includes the switch.

<Supplementary Note 6>

The work machine control method according to any one of Supplementary Note 1 to 5, in which when the second operation element is operated in association with the operation of the first operation element, the assistance control is executed to control the machine body in the manner to assist with the motion of the machine body corresponding to the operation of the first operation element.

<Supplementary Note 7>

The work machine control method according to any one of Supplementary Note 1 to 6, in which the machine body has the work unit including the arm, the boom, and the attachment, the arm is controlled by the operation of the first operation element, and at least one of the boom and the attachment is controlled by the operation of the second operation element.

<Supplementary Note 8>

The work machine control program for causing the one or more processors to execute the work machine control method according to any one of Supplementary Note 1 to 7.

REFERENCE SIGNS LIST

1: Work machine control system
3: Work machine
13: Change processing unit
14: Setting processing unit
30: Machine body
33: Work unit
35: Operation device
331: Bucket (attachment)
332: Boom
333: Arm
334: Breaker (attachment)
351, 352: Operation lever (first operation element)
Sw1, Sw2: Operation element (second operation element).
Sw11, Sw12, Sw21, Sw22: Switch (second operation element)

The invention claimed is:

1. A control method for a work machine including comprising a machine body, wherein the machine body makes a motion in accordance with operation of an operation device, the work machine control method comprising:

changing a first operation pattern to correspond to a first relationship between operation of a first operation element in the operation device and the motion of the machine body; and setting a second operation pattern associated with the first operation pattern, the second operation pattern corresponding to a second relationship between operation of a second operation element in the operation device and the motion of the machine body, wherein operation of the second operation element is performed in association with the operation of the first operation element, when the second operation element is operated within an operation acceptance period from an operation time point of the first operation element.

2. The work machine control method according to claim 1, wherein the second operation pattern is automatically changed in conjunction with a change of the first operation pattern.

3. The work machine control method according to claim 1, wherein the second operation element is arranged on the first operation element.

4. The work machine control method according to claim 1, wherein the first operation element comprises an operation lever, and the second operation element comprises a switch.

5. The work machine control method according to claim 1, wherein, operating the second operation element in association with the operation of the first operation element comprises, executing assistance control to control the machine body in a manner that assists with the motion of the machine body corresponding to the operation of the first operation element.

6. The work machine control method according to claim 1, wherein the machine body has a work unit comprising an arm, a boom, and an attachment, and the arm is controlled by operation of the first operation element, and at least one of the boom or the attachment is controlled by operation of the second operation element.

7. A non-transitory computer-readable medium embodying work machine control instructions for causing one or more processors to execute the work machine control method according to claim 1.

8. A work machine control system that is used for a work machine comprising a machine body, wherein the machine body makes a motion in accordance with operation of an operation device, the work machine control system comprising:

a change processing unit that changes a first operation pattern to correspond to a first relationship between operation of a first operation element in the operation device and the motion of the machine body; and a setting processing unit that sets a second operation pattern associated with the first operation pattern, the second operation pattern corresponding to a second relationship between operation of a second operation element in the operation device and the motion of the machine body, wherein operation of the second operation element is performed in association with the operation of the first operation element, when the second operation element is operated within an operation acceptance period from an operation time point of the first operation element.

9. A work machine comprising the work machine control system according to claim 8.

* * * * *